US010332335B2

(12) United States Patent
Halvorson et al.

(10) Patent No.: US 10,332,335 B2
(45) Date of Patent: Jun. 25, 2019

(54) GAMING SYSTEM AND METHOD HAVING ROW MODIFYING REELS WITH MODIFYING SYMBOLS

(71) Applicant: ADP GAUSELMANN GMBH, Espelkamp (DE)

(72) Inventors: Michael Charles Halvorson, Las Vegas, NV (US); Josef Alexander Hartl, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 52 days.

(21) Appl. No.: 15/721,296

(22) Filed: Sep. 29, 2017

(65) Prior Publication Data

US 2019/0102976 A1 Apr. 4, 2019

(51) Int. Cl.
*G07F 17/32* (2006.01)

(52) U.S. Cl.
CPC ..... *G07F 17/3213* (2013.01); *G07F 17/3209* (2013.01); *G07F 17/3251* (2013.01)

(58) Field of Classification Search
CPC ..... G07F 17/3213; G07F 17/34
See application file for complete search history.

(56) References Cited

U.S. PATENT DOCUMENTS 5,980,384 A * 11/1999 Barrie ..... G07F 17/3265 273/138.1
6,159,095 A * 12/2000 Frohm ..... G07F 17/32 273/269
6,251,013 B1 * 6/2001 Bennett ..... G07F 17/3211 273/143 R
6,290,600 B1 * 9/2001 Glasson ..... G07F 17/3265 273/143 R
6,311,976 B1 * 11/2001 Yoseloff ..... G07F 17/34 273/138.2
6,319,124 B1 11/2001 Baerlocher et al.
6,394,902 B1 5/2002 Glavich et al.
6,517,432 B1 * 2/2003 Jaffe ..... G07F 17/32 463/16
6,558,254 B2 5/2003 Baerlocher et al.
6,561,900 B1 * 5/2003 Baerlocher ..... G07F 17/34 273/143 R (Continued)

OTHER PUBLICATIONS

EIC 3700 STIC Search Results.*

*Primary Examiner* — Kang Hu
*Assistant Examiner* — Malina D. Blaise
(74) *Attorney, Agent, or Firm* — Resolute Legal PLLC

(57) ABSTRACT

A gaming system and method includes a first set of reels, where the reels are each associated with a plurality of symbols. The gaming system and method further includes at least one row modifying reel having one or more modifying symbols. If the at least one row modifying reel stops during a play of a game and a modifying symbol is visibly displayed in a display area of the gaming system, the modifying symbol indicates a visible row of the first set of reels. The gaming system is specially programmed to cause certain symbols in the indicated row to behave differently than the same certain symbols that appear on a non-indicated row. The behavior of the certain symbols in the indicated row may also change the behavior of symbols around the certain symbols in the indicated row.

19 Claims, 20 Drawing Sheets

(56) References Cited

U.S. PATENT DOCUMENTS 6,632,140 B2 * 10/2003 Berman ..... G07F 17/3211 463/18
6,692,356 B2 2/2004 Baerlocher et al.
6,780,109 B2 8/2004 Kaminkow
6,866,583 B2 3/2005 Glavich et al.
6,896,617 B2 * 5/2005 Daly ..... G07F 17/32 273/143 R
6,921,335 B2 * 7/2005 Rodgers ..... G07F 17/3265 273/138.1
7,052,395 B2 5/2006 Glavich et al.
7,137,888 B2 11/2006 Glavich et al.
7,384,334 B2 6/2008 Glavich et al.
7,393,277 B2 * 7/2008 Jackson ..... G07F 17/34 273/143 R
7,396,282 B2 7/2008 Gauselmann
7,399,225 B2 7/2008 Kaminkow
7,736,223 B2 * 6/2010 Pace ..... G07F 17/32 463/16
7,749,071 B2 7/2010 Marks et al.
7,922,573 B2 * 4/2011 Baerlocher ..... G07F 17/34 463/16
7,927,204 B2 * 4/2011 DeBrabander, Jr. .... G07F 17/34 463/16
7,959,504 B2 * 6/2011 Baumgartner ..... G07F 17/3286 463/20
8,002,626 B2 * 8/2011 Englman ..... G07F 17/3267 273/138.1
8,137,180 B2 * 3/2012 Thomas ..... G07F 17/34 463/18
8,152,627 B2 * 4/2012 Berman ..... G07F 17/34 463/16
8,162,741 B2 * 4/2012 Wadleigh ..... G07F 17/34 463/16
8,197,330 B2 * 6/2012 Englman ..... G07F 17/3244 463/20
8,231,460 B2 7/2012 Gauselmann
8,272,944 B2 * 9/2012 Englman ..... G07F 17/34 463/21
8,357,041 B1 * 1/2013 Saunders ..... G07F 17/326 463/16
8,382,571 B2 2/2013 Marks et al.
8,469,793 B2 * 6/2013 Visser ..... G07F 17/3265 463/16
8,506,380 B2 * 8/2013 Hughes ..... G07F 17/3265 463/20
8,517,814 B2 * 8/2013 Visser ..... G07F 17/3267 463/20
8,574,061 B2 11/2013 Marks et al.
8,608,543 B2 * 12/2013 Cuddy ..... G07F 17/3239 463/16
8,622,809 B1 * 1/2014 Arora ..... G07F 17/3258 463/20
8,814,658 B2 8/2014 Marks et al.
8,840,457 B1 * 9/2014 Basallo ..... G07F 17/34 463/20
9,011,233 B2 * 4/2015 Ryan ..... G07F 17/3244 463/16
9,129,492 B2 9/2015 Marks et al.
9,153,090 B2 * 10/2015 Pacey ..... G07F 17/3244
9,177,448 B2 * 11/2015 Caputo ..... G07F 17/34
9,214,067 B2 * 12/2015 Basallo ..... G07F 17/326
9,218,705 B2 * 12/2015 Taylor ..... G07F 17/3265
9,449,470 B2 * 9/2016 Baerlocher ..... G07F 17/326
9,460,587 B2 * 10/2016 Saunders ..... G07F 17/34
9,704,342 B2 * 7/2017 Aoki ..... G07F 17/3265
9,710,998 B2 * 7/2017 Nelson ..... G07F 17/3211
9,786,116 B2 * 10/2017 Saunders ..... G07F 17/3211
9,805,542 B2 * 10/2017 Rodgers ..... G07F 17/3262
9,805,553 B2 * 10/2017 Zielinski ..... G07F 17/3267
9,852,574 B2 * 12/2017 Zoltewicz ..... G07F 17/326
2001/0054794 A1 * 12/2001 Cole ..... G07F 17/3239 273/138.1
2003/0022712 A1 * 1/2003 Locke ..... G07F 17/3211 463/20
2004/0043809 A1 * 3/2004 Gomez ..... G07F 17/32 463/16
2004/0048646 A1 * 3/2004 Visocnik ..... G07F 17/32 463/16
2005/0130737 A1 * 6/2005 Englman ..... G07F 17/32 463/25
2005/0159208 A1 * 7/2005 Pacey ..... G07F 17/3211 463/20
2006/0058097 A1 * 3/2006 Berman ..... G07F 17/3244 463/20
2006/0068892 A1 * 3/2006 Gomez ..... G07F 17/3244 463/20
2006/0154717 A1 * 7/2006 Jackson ..... G07F 17/32 463/20
2006/0189377 A1 * 8/2006 Gomez ..... G07F 17/3244 463/20
2009/0131150 A1 * 5/2009 Iverson ..... G07F 17/3211 463/20
2009/0137311 A1 * 5/2009 Iverson ..... G07F 17/3202 463/20
2011/0034234 A1 * 2/2011 Berman ..... G07F 17/3265 463/20
2011/0117989 A1 * 5/2011 Kennedy ..... G07F 17/34 463/20
2011/0230251 A1 * 9/2011 Nicely ..... G07F 17/32 463/20
2013/0143639 A1 * 6/2013 Nakamura ..... G07F 17/32 463/20
2014/0038693 A1 * 2/2014 Lanning ..... G07F 17/3202 463/20
2014/0274294 A1 * 9/2014 Baerlocher ..... G07F 17/34 463/20
2014/0357342 A1 * 12/2014 Elias ..... G07F 17/32 463/20
2015/0310699 A1 * 10/2015 Meyer ..... G07F 17/326 463/20
2015/0348374 A1 * 12/2015 Dupuis ..... G07F 17/34 463/20
2016/0078711 A1 * 3/2016 Rucker ..... G07F 17/34 463/21
2016/0086429 A1 * 3/2016 Inamura ..... G07F 17/326 463/20

* cited by examiner

GAMING SYSTEM AND METHOD HAVING ROW MODIFYING REELS WITH MODIFYING SYMBOLS

FIELD OF THE INVENTION

The present disclosure relates to gaming devices and systems.

SUMMARY OF THE INVENTION

Various embodiments of the present disclosure provide a gaming system and method comprising a row modifying reel having one or more modifying symbols. When the row modifying reel stops spinning during a play of the game and one of the modifying symbols is displayed in a display area of the gaming system, the displayed modifying symbol causes the gaming system to modify one or more other symbols displayed in a row that aligns with the modifying symbol in the game played on the gaming system.

In one embodiment, the gaming system and method comprises a first set of reels, where the reels are each associated with a plurality of symbols. The gaming system and method further comprises a row modifying reel having one or more modifying symbols. If the row modifying reel stops during a play of a game and a modifying symbol is visibly displayed in a display area of the gaming system, the modifying symbol indicates a visible row of the first set of reels. The gaming system is specially programmed to cause certain symbols in the indicated row to behave differently than the same certain symbols that appear on a non-indicated row. The behavior of the certain symbols in the indicated row may also change the behavior of symbols around the certain symbols in the indicated row.

In one embodiment of the gaming system and method, when the first set of reels are stopped during a play of a game and a predetermined symbol appears in the indicated row of the first set of stopped reels, such predetermined symbol may cause certain other visible symbols around the predetermined symbol to change. For example, such predetermined symbol may cause the gaming system to change certain other visible symbols around the predetermined symbol into the predetermined symbol.

In one embodiment, the predetermined symbol may also change. For example, such predetermined symbol may flip or turn a predetermined number of degrees (e.g., approximately 180 degrees or other suitable number of degrees) to reveal a different symbol. In such an embodiment, the different symbol may cause the gaming system to change certain other visible symbols around the different symbol into the different symbol.

In one embodiment, when the first set of reels are stopped during a play of a game and the predetermined symbol appears in a visible row of the first set of reels that is not indicated by the modifying symbol, the predetermined symbol will behave differently than the predetermined symbol appearing in the indicated row of the first set of reels. In one such example, if the predetermined symbol appears in a visible row of the first set of reels that is not indicated by the modifying symbol, the gaming system does not change the predetermined symbol and does not change certain other visible symbols around the predetermined symbol into the predetermined symbol. It should be appreciated that in one embodiment, the gaming system may reverse the actions of the predetermined symbol that occurs when the predetermined symbol appears in the indicated row and the non-indicated row.

In one embodiment, the row modifying reel may be oriented vertically with respect to the first set of reels (e.g., the row modifying reel will be positioned similar to the first set of reels and configured to spin in a similar direction to the first set of reels). In other embodiments, the gaming system may include two or more row modifying reels. In one such example, a modifying symbol must appear in the same row of each row modifying reels before the gaming system changes the behavior of displayed symbols on the first set of reels discussed above. In another such example, a modifying symbol may appear in one row of one of the row modifying reels to trigger the symbol behavior changes discussed above while a payout multiplier may appear in the other row modifying reel to increase the player's winnings. In another such example, a modifying symbol must appear in one row of one of the row modifying reels to trigger the symbol behavior while a payout multiplier must appear in the other row modifying reel to increase the player's winnings.

In one embodiment, the gaming system and method comprises a first set of five reels and a row modifying reel. Each reel includes a plurality of symbol positions. Each of the five reels in the first set is associated with a plurality of symbols that is positioned at one of the plurality of symbol positions. The plurality of symbols may include any suitable symbol (including "blank" symbols). At least one of the plurality of symbols may be a Flipside Frenzy symbol (e.g., a type of wild symbol that can mimic or substitute for any one or more of the other plurality of symbols associated with the first set of five reels). The row modifying reel is also associated with one or more modifying symbols. The modifying symbols may be an arrow or other suitable symbol that indicates a visible row across the first set of five reels. The gaming system further includes a display area that shows a certain section of the first set of five reels and a certain section of the row modifying reel. In one embodiment, the display area may show three symbol positions of each of the five reels (e.g., creating a visible 3 row×5 column area of symbol positions of the first set of five reels). The display area may also show three symbol positions of the row modifying reel (e.g., creating a visible 3 row×1 column an area of the row modifying reel). In different embodiments, each of the five reels and the row modifying reel maybe evenly spaced from each other (or touching each other) so that the player does not discern a difference between the different reels. In other embodiments, the set of five reels is visibly separated from the row modifying reel enabling a player to easily discern a difference between the set of five reels and the row modifying reel.

In one such embodiment, when a modifying symbol is visibly displayed on a stopped row modifying reel, the modifying symbol indicates a row across the first set of five reels. If the gaming system also visibly displays a Flipside Frenzy symbol on one of the stopped reels of the first set of five reels and the Flipside Frenzy symbol is in the indicated row, the Flipside Frenzy symbol may cause the gaming system to convert at least one or all of the other visible symbols on the same reel into the Flipside Frenzy symbol. The gaming system may evaluate the displayed symbol combinations to determine any awards the player should receive based on the displayed symbols. For example, matching symbols on a wagered pay line causes the player to receive an award. For purposes of determining the player award, the Flipside Frenzy symbol may be treated like any one or more of the other plurality of symbols associated with the first set of five reels. In one example embodiment, a visible row of the stopped first set of five reels includes four cherry symbols and a Flipside Frenzy symbol. Five cherry symbols in a row along a wagered pay line is associated a winning symbol combination. Since the gaming system treats the Flipside Frenzy symbol as a cherry symbol in this example, the gaming system evaluates the four cherry symbols and a Flipside Frenzy symbol as a winning combination of five cherry symbols in a visible row (along the wagered pay line). In this embodiment, the row modifying reel is excluded from the determination of a winning symbol combination along a pay line.

It should be appreciated that showing the player how predetermined symbols are modified and how the modifying symbol impacts other displayed symbols creates a greatly improved sense of anticipation for players unique to the gaming field.

DETAILED DESCRIPTION OF THE INVENTION

Figure 1:
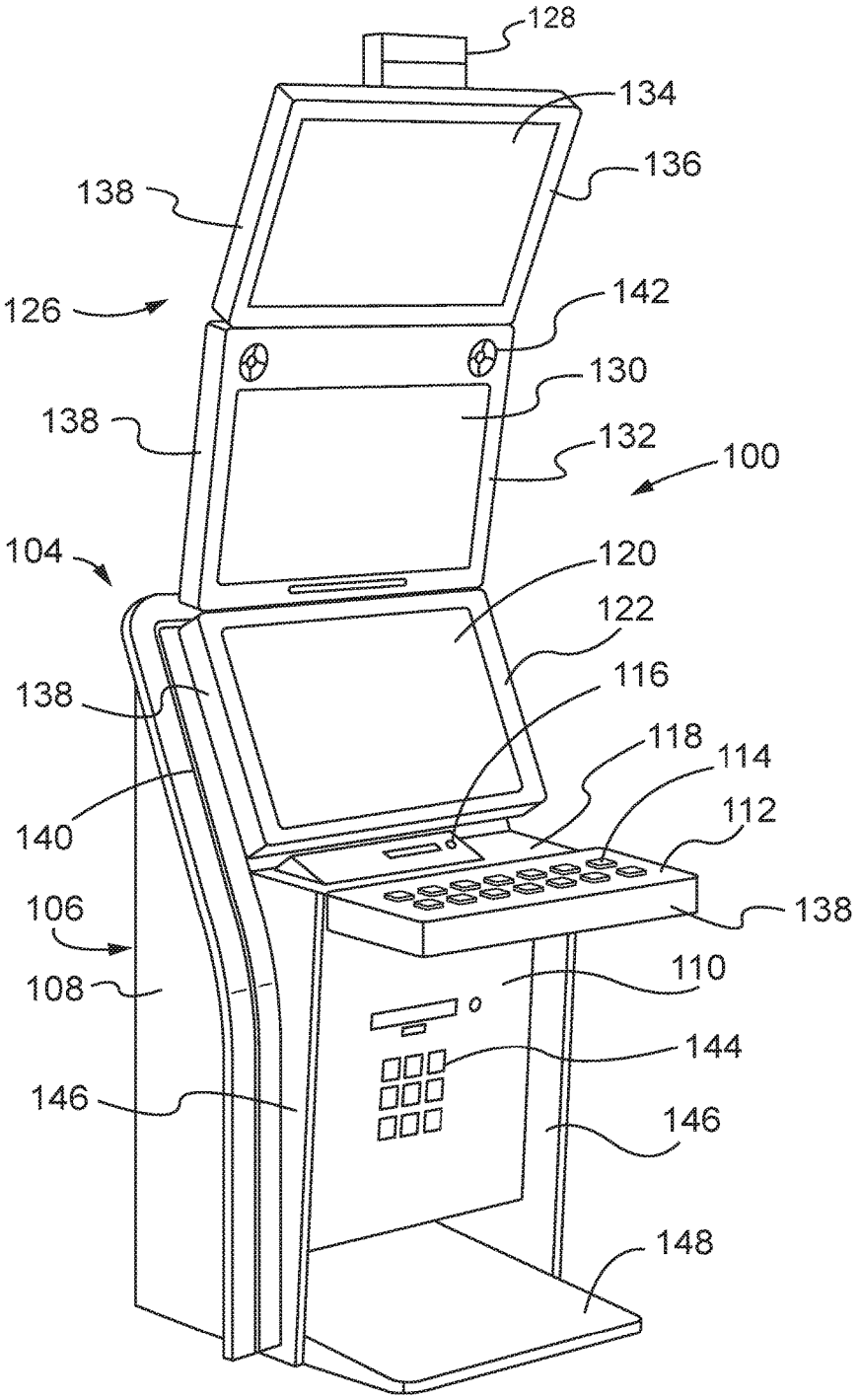
FIG. 1 is a perspective view of an embodiment of a stand-alone gaming device of the gaming system.

Various embodiments of the present disclosure provide a gaming system and method comprising a row modifying reel having one or more modifying symbols. If the row modifying reel stops spinning during a play of a game and one of the modifying symbols is displayed in a display area of the gaming system, the displayed modifying symbol may cause the gaming system to modify one or more other symbols displayed in the game played on the gaming system.

In one embodiment of the method, the gaming system may receive a monetary value from a player via a value acceptor device. The gaming system may determine, via a processor of the gaming device, a credit balance based on the monetary value received. The gaming system may receive, via a player input device, a wager for a play of a game at the gaming device. The gaming system may use a processor of the gaming device to update a gaming credit balance in accordance with the amount of the wager. The gaming system may receive, via a player input device, a request to initiate a play of the game. The gaming system may use a random number generator to randomly generate a plurality of symbols for display on each game reel of a first set of reels. The gaming system may also use a random number generator to randomly generate at least one symbol from a set of modifying symbols for display on a symbol modifying reel. The gaming system may cause a display device to display the plurality of symbols generated for the first set of reels and the at least one symbol for a symbol modifying reel. The gaming system may determine, using a processor of the gaming device, if any of the plurality of symbols are to be modified by the modifying symbol. If it is determined that none of the plurality of symbols are to be modified by the modifying symbol, the gaming system evaluates the displayed symbols for winning symbol combinations along wagered pay lines. If any of the displayed plurality of symbols of the first set of reels are to be altered because of the modifying symbol, the gaming system uses the processor of the gaming device to alter and display the altered symbols on a display device. The gaming system may evaluate, by the processor of the gaming device, the displayed symbols (including the altered symbols) for winning symbol combinations along wagered pay lines. The gaming system may update, by the processor of the gaming device, the gaming credit balance in accordance with any award amount based on the winning symbol combinations. The gaming system can dispense a value to the player via a value dispenser of the gaming device in accordance with the player gaming credit balance when receiving a signal to cash out or otherwise end the gaming session at the gaming device.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input features and locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing features of protection of/access to gaming electronics, displays, and player I/O features described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
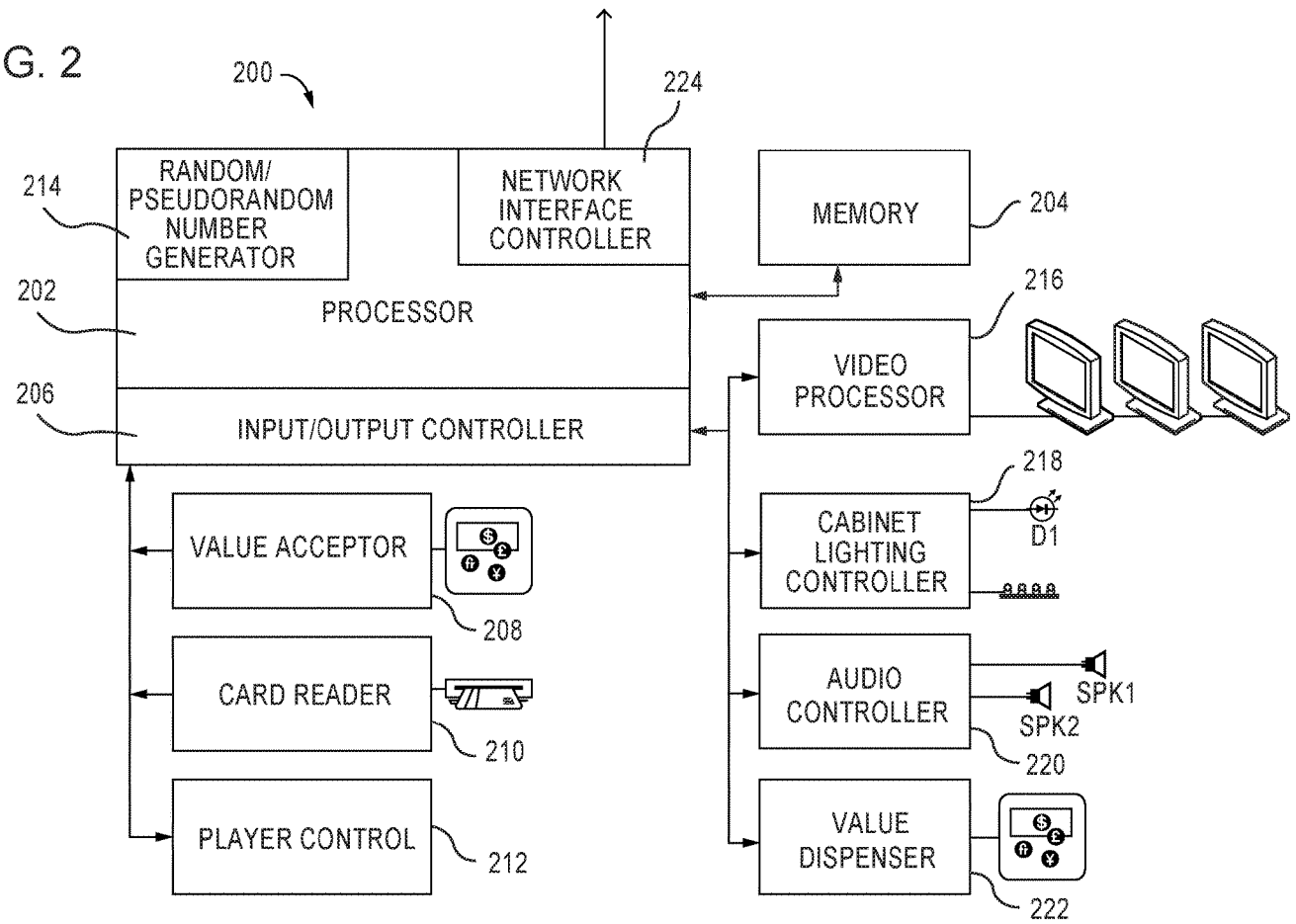
FIG. 2 is a functional block diagram of the gaming device technology components.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, the random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The gaming device 100 can set the reels into a spinning/rotation motion based on a signal triggered by pulling a lever or pushing a button on the gaming device 100. In some embodiments, the gaming device 100 can stop the reels by the gaming device 100 actuating, on a random timing basis, a suitable mechanical or electro-mechanical reel brake. When the reels stop rotating, one or more displayed stop positions of each reel are detected. Since the stop positions are each associated with an indicia or symbol, the gaming device can determine whether the combination of displayed stop positions (i.e., translating to a combination of displayed symbols) results in one or more winning symbol combinations.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Game Including at Least One Row Modifying Reel

FIGS. 3-7 describe some embodiments which provide a gaming system and method including at least one row modifying reel having one or more modifying symbols.

FIGS. 3A, 3B, 3C, and 3D illustrate screen shots of one embodiment of a gaming system having a row modifying reel and one or more modifying symbols.

Figure 3A:
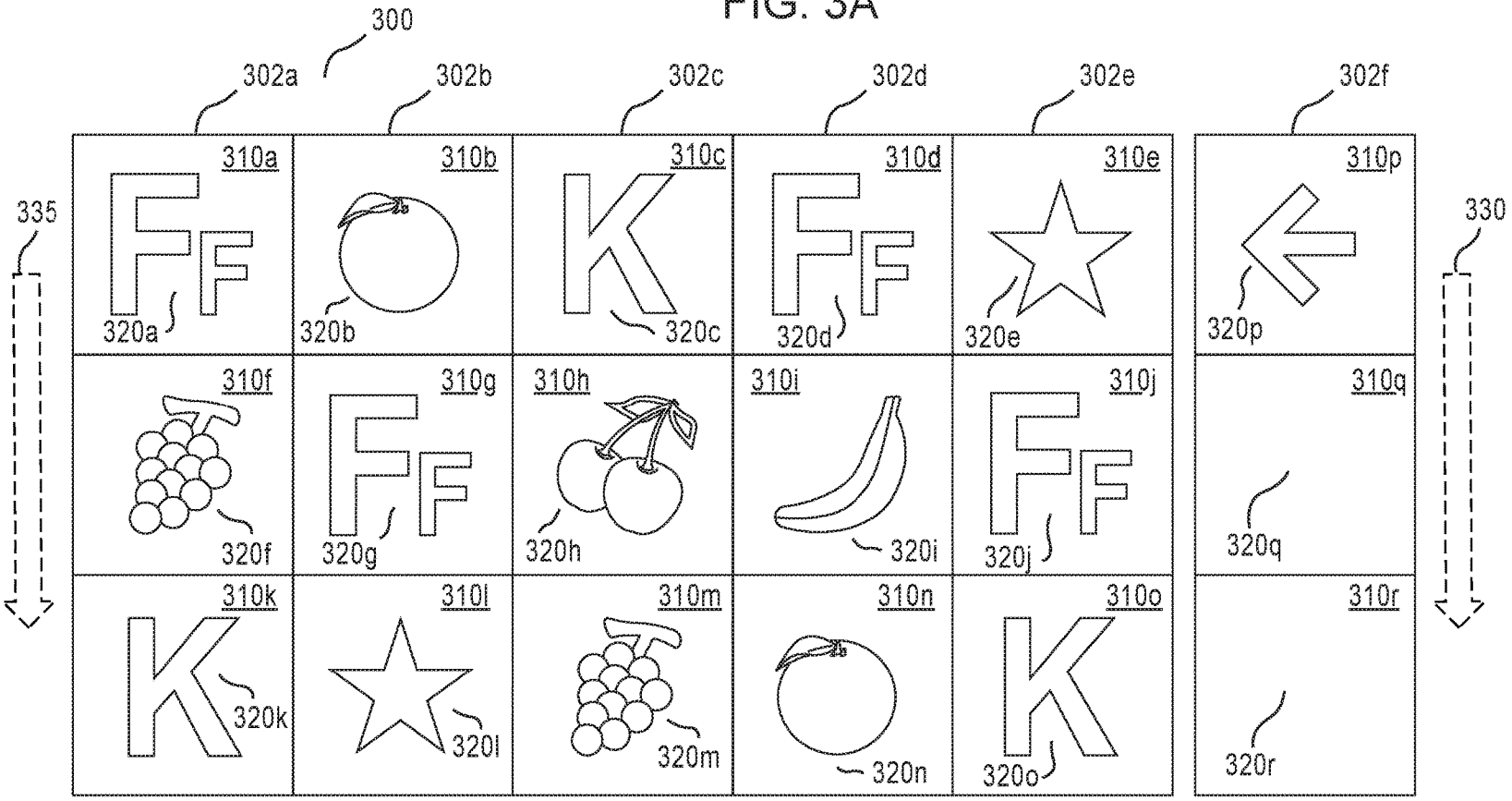
FIGS. 3A, 3B, 3C, and 3D illustrate screen shots of an example embodiment of a gaming system having a row modifying reel and one or more modifying symbols.

FIG. 3A illustrates one embodiment of a game display that is displayed by the gaming system on a display device of the gaming device 100. In one embodiment, game display 300 may be displayed on first display 122 of gaming device 100 illustrated in FIG. 1. However, any other suitable display may be used. The game display 300 displays a set of a plurality of reels 302*a*, 302*b*, 302*c*, 302*d*, 302*e*, and 302*f* as illustrated in FIG. 3A. As also illustrated in FIG. 3A, the reels 302*a*-302*e* are displayed substantially side by side while reel 302*f* is depicted as separated from reels 302*a*-302*e*. It should be appreciated that reel 302*f* can be displayed substantially side by side with reels 302*a*-302*e* in some embodiments. It should be appreciated that reels 302*a*-302*f* can be displayed with any suitable amount of separation or no separation.

The plurality of reels 302*a*-302*e* are each associated with a first set of symbols, where the first set of symbols includes a plurality of symbols. Each reel 302*a*-302*e* is associated with a plurality of symbols of the first set of symbols. Each reel 302*a*-302*e* can also be associated the same or a different plurality of symbol combinations from the first set of symbols. Reel 302*f* is associated with a second set symbols, where the second set of symbols includes at least one modifying symbol.

The first set of symbols may include numbers, letters, geometric figures, symbols, images, character, blank symbols (e.g., the absence of symbols), animations, or any other suitable graphical depiction. In one embodiment, the second set of symbols includes at least one modifying symbol such as a directional arrow. However, it should be appreciated that the second set of symbols may also include any suitable symbol such as numbers, letters, geometric figures, symbols, images, character, blank symbols (e.g., the absence of symbols), animations, or any other suitable graphical depiction.

Symbols in the first set of symbols may be associated with special features. These special features may trigger the gaming system to perform a particular function when such symbols are visibly displayed on a stopped reel. In one example, the appearance of a symbol designated to trigger a bonus game may cause the gaming system to execute a bonus game. In another example, the appearance of a symbol designated to trigger free spins may cause the gaming system to execute a certain number of free spins.

In another example, one of the symbols in the first set of symbols can be a Flipside Frenzy symbol such as symbol 320*a*. The Flipside Frenzy symbol is a type of wild symbol that can mimic or substitute for any one or more of the other plurality of symbols of the first set of symbols. That is, the appearance of a Flipside Frenzy symbol on a stopped reel may cause the gaming system to evaluate the Flipside Frenzy symbol like one of the other symbols along a wagered pay line for purposes of determining a winning symbol combination. In another embodiment, gaming system may cause the Flipside Frenzy symbol to flip or turn a predetermined number of degrees (e.g., approximately 180 degrees or other suitable number of degrees) to reveal a different symbol. In such an embodiment, the different symbol may cause the gaming system to change certain other visible symbols around the different symbol into the different symbol. In another embodiment, the gaming system may cause other visible symbols on the reel displaying the Flipside Frenzy symbol to change into the Flipside Frenzy symbol. In some embodiments, the gaming system does not execute any functions associated with the Flipside Frenzy symbol unless another predetermined symbol is visibly displayed. For example, the gaming system may not execute any functions associated with the Flipside Frenzy symbol unless a modifying symbol is visibly displayed on stopped reel 302*f*. In one such embodiment, the modifying symbol must appear in the same row as the Flipside Frenzy symbol before the gaming system executes any functions associated with the Flipside Frenzy symbol.

In one embodiment, the gaming system may cause the Flipside Frenzy symbol to flip one or more times and reveal a different symbol each time the gaming system flips the Flipside Frenzy symbol. In one embodiment, for each flip of the Flipside Frenzy symbol, the gaming system evaluates the wagered pay lines for winning symbol combinations based on the currently displayed symbol in place of the Flipside Frenzy symbol. For example, if a Flipside Frenzy symbol flipped to reveal a new cherry symbol, the gaming system may evaluate all of the wagered pay lines to determine if the new cherry symbol creates any winning symbol combinations along any wagered pay lines. The gaming system may store any awards based on the winning symbol combinations formed with the new cherry symbol before, during, or after the Flipside Frenzy symbol turned into the cherry symbol. If the gaming system flipped the Flipside Frenzy symbol (displaying the new cherry symbol) again to reveal a new seven symbol, the gaming system may evaluate all of the wagered pay lines to determine if the new seven symbol creates any winning symbol combinations along any wagered pay lines. The gaming system may store any awards based on the winning symbol combinations formed with the new seven symbol before, during, or after the Flipside Frenzy symbol turned into the seven symbol. The gaming system may continue to evaluate the winning symbol combinations along wagered pay lines for each additional flip of the Flipside Frenzy symbol.

In some embodiments, the Flipside Frenzy symbol flips one time and reveals one different symbol. In some embodiments, the Flipside Frenzy symbol flips a plurality of times to reveal a plurality of different symbols. In some embodiments, the Flipside Frenzy symbol flips a plurality of times to reveal each symbol from the first set of symbols. In other embodiments, the Flipside Frenzy symbol flips a plurality of times to reveal a subset of the first set of symbols. In other embodiments, the Flipside Frenzy symbol may flip and reveal symbols from a different set of symbols. In some embodiments, the timing of the flips are predetermined. In other embodiments, the timing of the flips are randomly determined. In one embodiment, the flips occur at predetermined time intervals. In some embodiments, the gaming system flips the Flipside Frenzy symbol at a speed to enable the player to visibly discern the flipping symbols and to understand the affect each flip has on the player's awards. In other embodiments, the flips can occur at any speed.

It should be appreciated that the different embodiments of the Flipside Frenzy symbol may be combined in any suitable manner. For example, in one embodiment, the gaming system may cause other visible symbols on the reel displaying a Flipside Frenzy symbol to change into the Flipside Frenzy symbol and cause all displayed Flipside Frenzy symbols to flip into different symbols as discussed above. In some embodiments, the flipped symbols are flipped to the same symbols for each flipped Flipside Frenzy symbol. In other embodiments, the one or more flipped Flipside Frenzy symbols flip to different symbols from at least one other flipped Flipside Frenzy symbol. The gaming system may first evaluate the displayed symbols with the Flipside Frenzy symbols for winning symbol combinations (e.g., treating the Flipside Frenzy symbol like wild symbols). The gaming system may cause one or more of the displayed Flipside Frenzy symbols to flip into one or more different symbols. For each new flip of a Flipside Frenzy symbol, the gaming system may evaluate the displayed symbols with the newly flipped symbol for winning symbol combinations. Each evaluation may contribute to increasing the player's award amount based on newly formed winning symbol combinations. It should be appreciated that the gaming system may flip one or more displayed Flipside Frenzy symbols based on a triggering event or no triggering event. In one such triggering event embodiment, the gaming system flips a Flipside Frenzy symbol when a modifying symbol appears in the same row as the Flipside Frenzy symbol. In other such triggering event embodiments, the gaming system flips all Flipside Frenzy symbols when a modifying symbol appears in the same row as one Flipside Frenzy symbol.

In one embodiment, a modifying symbol is a symbol that can identify or indicate a row of visible symbols. The appearance of a modifying symbol can identify to a player and the gaming system that certain game functions may be performed on symbols in the indicated row of symbols. For example, a modifying symbol 320*p* (the arrow) indicates the first row of reels 302*a*-302*e*. Based on the indication of the modifying symbol 320*p*, the gaming system may evaluate the symbols along this row to determine if additional game functions should be executed. For example, the gaming system may be specially programmed to cause symbol 320*f* and 320*k* of reel 302*a* to convert into a Flipside Frenzy symbol because the Flipside Frenzy symbol 320*a* appeared in the visible row indicated by modifying symbol 320*p*. On the other hand, while a Flipside Frenzy symbol 320*g* is also visibly displayed, if Flipside Frenzy symbol 320*g* is not in an indicated row, the gaming system may determine not to change symbols 320*b* and 320*l* into Flipside Frenzy symbols. Thus, in some embodiments, certain symbols in an indicated row 302*a*-303*e* may behave differently than the same certain symbols that appear in a non-indicated row.

In other embodiments, symbols other than the Flipside Frenzy symbol can be used in conjunction with the modifying symbol to cause the gaming system to execute additional game functions. In still other embodiments, the modifying symbol may indicate a row as well as a type of action to perform based upon the content displayed in the modifying symbol. For example, the content of the modifying symbol may include a direction. The gaming system may use the direction to determine which symbols are permitted to change (such as, into Flipside Frenzy symbols). In another example, the modifying symbol may include a number as the content. The number displayed with the modifying symbol may determine how many symbols can be changed. Various game operation embodiments are described in greater detail below.

Returning now to FIG. 3A, the game display 300 also depicts a plurality of symbol display areas (or symbol positions) 310*a*, 310*b*, 310*c*, 310*d*, 310*e*, 310*f*, 310*g*, 310*h*, 310*i*, 310*j*, 310*k*, 310*l*, 310*m*, 310*n*, 310*o*, 310*p*, 310*q*, and 310*r*. These plurality of symbol display areas can be associated in a manner that provides the appearance of game reels. As illustrated in FIG. 3A, symbol display areas 310*a*, 310*b*, 310*c*, 310*d*, 310*e*, 310*f*, 310*g*, 310*h*, 310*i*, 310*j*, 310*k*, 310*l*, 310*m*, 310*n*, 310*o* are associated in a manner that provides the appearance of a first set of five game reels. In one embodiment, the plurality of symbol display areas that provide the appearance of five game reels may be arranged in a manner that visibly shows three symbol display areas of each of the five game reels. For example, the symbol display areas 310*a*-310*o* are each associated with positions on reels 302*a*-302*e*. The symbol display areas 310*p*-310*r* are associated with positions on reel 302*f*. As shown in FIG. 3A, symbol display areas 310*a*, 310*f*, and 310*k* are associated with reel 302*a*; symbol display areas 310*b*, 310*g*, and 310*l* are associated with reel 302*b*; symbol display areas 310*c*, 310*h*, and 310*m* are associated with reel 302*c*; symbol display areas 310*d*, 310*i*, and 310*n* are associated with reel 302*d*; symbol display areas 310*e*, 310*j*, and 310*o* are associated with reel 302*e*; and symbol display areas 310*p*, 310*q*, and 310*r* are associated with reel 302*f*. The arrangement illustrated in the embodiment of FIG. 3A thus creates a visible display area of the reels 302*a*-302*f* comprising three symbol display areas for each reel. When viewed together, reels 302*a*-302*e* appear like a 3-row by 5-column reel array in display 300 and reel 302*f* appear like a 3-row by 1 column reel array the display 300. In other embodiments, smaller or larger visible areas of the reels can be displayed. That is, the reels 302*a*-302*f* may show fewer or a larger numbers of visible symbols. While symbol display areas are illustrated with defined boxes, it should be appreciated that in some embodiments, the defined boxes are not visible to the player.

Each reel 302*a*-302*e* may display a plurality of symbols from the first set of symbols in their respective symbol display areas as illustrated in FIG. 3A. Reel 302*f* may display one or more symbols from the second set symbols in its symbol display areas illustrated in FIG. 3A.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above.

To initiate of a play of a game, the player presses one or more appropriates buttons on the gaming system to deduct credits necessary to play the game and to identify the player's wager. The player's wager may include identifying pay lines or other game features the player wishes to activate in exchange for the wager. The player may also actuate a game start button or a spin button. The gaming system may deduct the appropriate credits from the player's credit balance after the wager or at any suitable time.

Upon receipt of the player's wager and activation of the game start button, the gaming system may show an animation of spinning reels as indicated by direction arrows 330 and 335 of FIG. 3A for each of the reels 302*a*-302*f*. In one embodiment, the gaming system randomly generates symbols 320*a*-320*r* from the first and second set of symbols for reels 302*a*-302*f*, respectively. As noted above, the gaming system may rely on random generation performed by a pseudo RNG or a true or hardware RNG. The gaming system displays the generated symbols 320*a*-320*r* in symbols display areas 310*a*-310*r* as illustrated in FIG. 3A. Symbols 320*a*-320*r* displayed on reels 302*a*-302*e* illustrate the randomly generated symbols after the reels have stopped spinning. It should be noted that in some embodiments, the reel spin direction arrows 330 and 335 may both be reversed from the shown direction or they may spin in opposite directions relative to each other.

As illustrated in FIG. 3A, the gaming system randomly generated and displayed symbols 320*a*, 320*f*, and 320*k* in symbol display areas 310*a*, 310*f*, and 310*k* for reel 302*a*. The gaming system also randomly generated and displayed symbols 320*b*, 320*g*, and 320*l* in symbol display areas 310*b*, 310*g*, and 310*l* for reel 302*b*; symbols 320*c*, 320*h*, and 320*m* in symbol display areas 310*c*, 310*h*, and 310*m* for reel 302*c*; symbols 320*d*, 320*i*, and 320*n* in symbol display area 310*d*, 310*i*, and 310*n* for reel 302*d*; symbols 320*e*, 320*j*, and 320*o* in symbol display area 310*e*, 310*j*, and 310*o* for reel 302*e*. The gaming system further randomly generated and displayed symbols 320*p*, 320*q*, and 320*r* in symbol display area 310*p*, 310*q*, and 310*r* for reel 302*f*.

As illustrated in FIG. 3A, the gaming system generated and displayed Flipside Frenzy symbols (320*a*, 320*d*, 320*g*, 320*j*), orange symbols (320*b*, 320*n*), grape symbols (320*f*, 320*m*), a cherry symbol (320*h*), a banana symbol (320*i*), a K or King symbol (320*c*, 320*k*, 320*o*)), and star symbol (320*e*, 320*l*). The gaming system also generated and displayed an arrow or pointer symbol 320*p* and blank symbols 302*q* and 320*r* for reel 302*f*. However, is should be appreciated that the displayed symbol combinations are merely for explanatory purposes and the gaming system may randomly generate any suitable combination of symbols based on defined symbol sets.

Figure 3B:
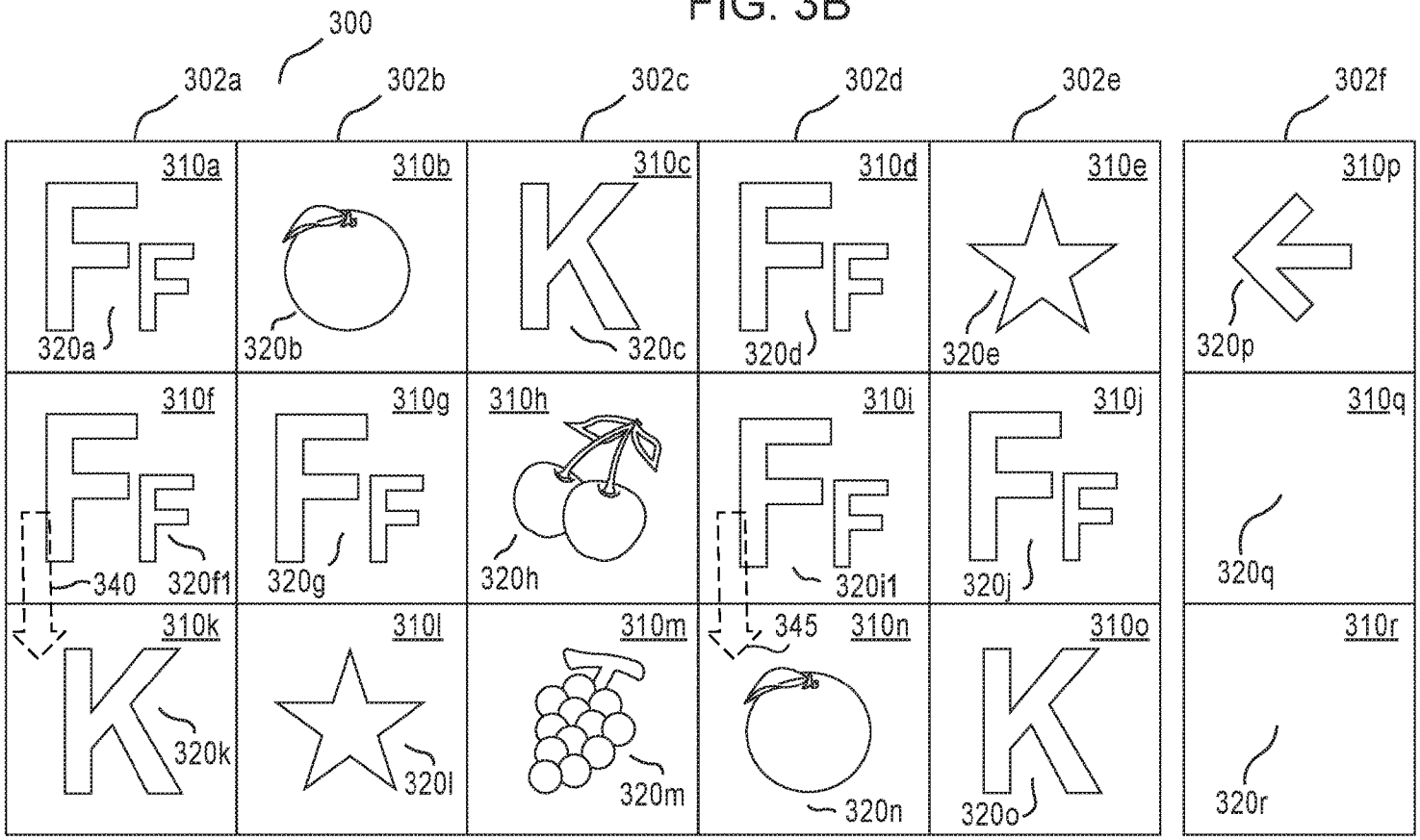

FIG. 3B illustrates one embodiment of the gaming system performing an evaluation of the generated symbols on reels 302*a*-302*f* and executing game functions to change behaviors of symbols based on an indicated row of symbols. The gaming system determines that modifying symbol 320*p* was generated and displayed in position 310*p* of reel 302*f* Modifying symbol 320*p* is an arrow graphic that indicates or points to the first row the visible symbols on reels 302*a*-302*e*. This row indication provides a clear acknowledgment to a player that the gaming system may evaluate and possibly execute game functions on the first row of the visible symbols on reels 302*a*-302*e*. In one embodiment, the gaming system evaluates (such as using processor 202) the first row of the visible symbols on reels 302*a*-302*e* and determines that a Flipside Frenzy symbol 320*a* is visible in symbol display area 310*a* and a Flipside Frenzy symbol 320*d* is visible in symbol display area 310*d*. In this embodiment, the appearance of a Flipside Frenzy symbol in the indicated row triggers or otherwise causes the gaming system to change the behavior of symbols around the Flipside Frenzy symbols.

In the embodiment illustrated in FIG. 3B, the gaming system causes the Flipside Frenzy symbols 320*a* and 320*d* to expand in the direction of dotted arrows 340 and 345 to the remaining visible symbols positions on reels 302*a* and 302*d*. As is illustrated in FIG. 3B, a Flipside Frenzy symbol 320*f*1 has expanded to symbol display area 310*f* on reel 302*a* and replaced the prior symbol 320*f*. Likewise, a Flipside Frenzy symbol 320*i*1 has expanded to symbol display area 310*i* on reel 302*d* and replaced the prior symbol 320*i*.

While the illustrations in the figures of the disclosure show symbols expanding to other symbol display areas and replacing the existing symbols, other transformations may be used in place of the expanding symbol. For example, the Flipside Frenzy symbol may grow in the symbol display areas slated for transformation into the Flipside Frenzy symbol. In some embodiments, the symbol in a symbol display area that is slated for transformation may morph into the Flipside Frenzy symbol.

In some embodiments, the Flipside Frenzy symbol only impacts or changes predetermined base symbols. In some such embodiments, scatter pay, bonus game triggering symbol, free spin symbols, and other symbols associated with special game features are not affected by the Flipside Frenzy symbol change. That is, in these embodiments, scatter pay and other such symbols associated with special game features will not be replaced whether through expansion, growth, morphing, or other suitable changes, while base game symbols are replaced. In other embodiments, the Flipside Frenzy symbol can change all symbols without regard to a symbol's association with special game features.

In yet other embodiments, the Flipside Frenzy symbols may also transform into different symbols when in an indicated row as discussed above. The transformation may further include animating the Flipside Frenzy symbol in such a manner as to appear to spin about an axis or flip sides to a different symbol.

It should be appreciated that the ability to alter the behavior of the Flipside Frenzy symbol and other symbols is not limited to the Flipside Frenzy symbol. Any suitable symbol can be designated to perform similar game functions noted herein when appearing in a row indicated by a modification symbol. It should also be appreciated that the gaming system can also be specially configured to execute other behavior changes to symbols to increase a player's anticipation of the game.

Figure 3C:
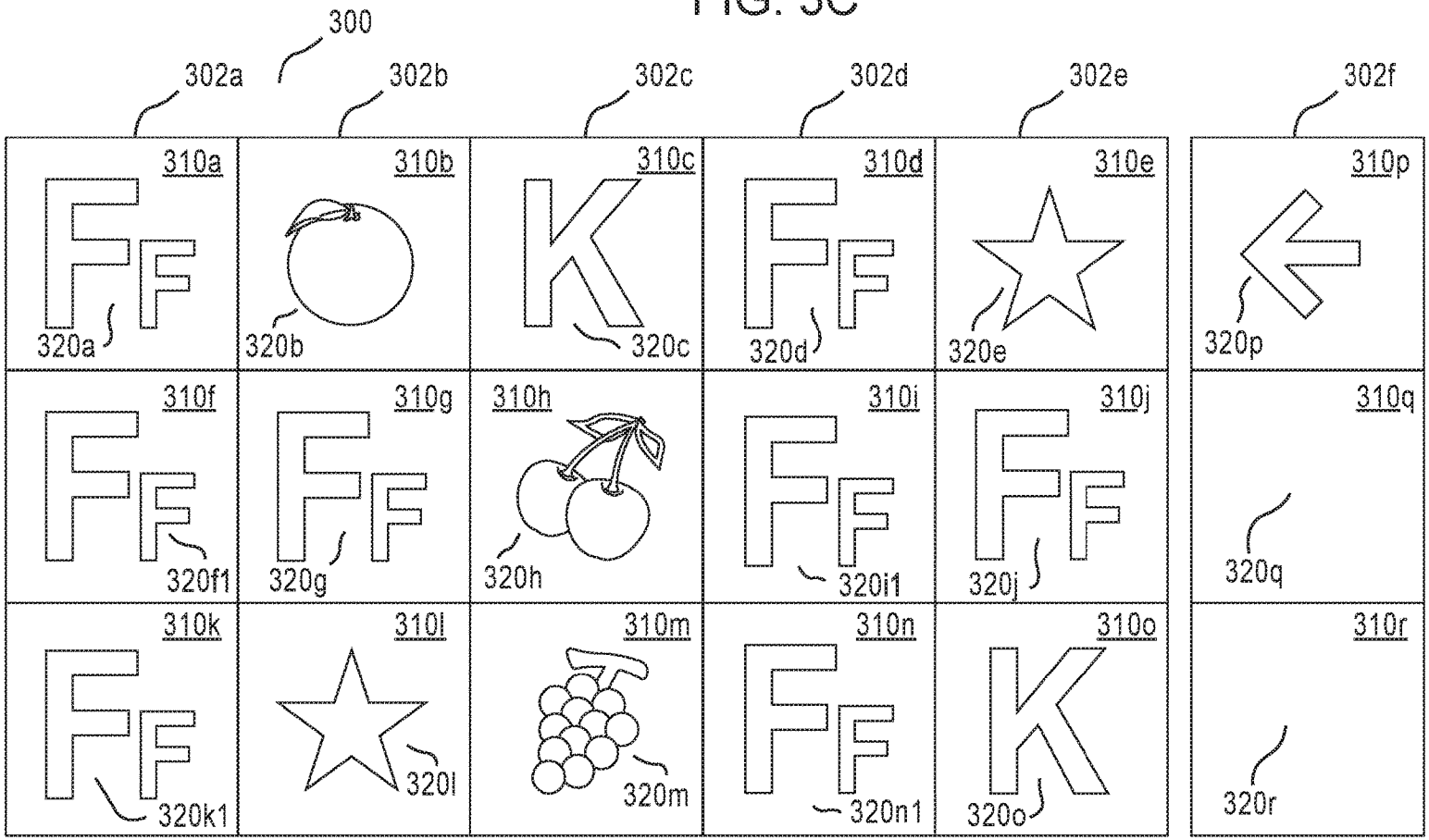

FIG. 3C illustrates a continuation of the gaming system executing game functions to change behaviors of symbols based on an indicated row of symbols as discussed above in FIG. 3B. More specifically, FIG. 3C illustrates one embodiment where the Flipside Frenzy symbols continued to expand to populate entire reels 302*a* and 302*d* with Flipside Frenzy symbols. As is illustrated in FIG. 3C, a Flipside Frenzy symbol 320*k*1 has expanded to symbol display area 310*k* on reel 302*a* and replaced the prior symbol 320*k*. Likewise, a Flipside Frenzy symbol 320*n*1 has expanded to symbol display area 310*n* on reel 302*d* and replaced the prior symbol 320*n*. The expanding symbols may increase the player's anticipation of increased awards and further increase the player's enjoyment of the game.

If the gaming system determines that no other symbols are affected by the row indication from symbol 320*p*, the gaming system evaluates the displayed symbol combinations for winning symbol combinations. It should be appreciated that the gaming system can evaluate the displayed symbols for winning combinations at any time. For example, the game system may evaluate the displayed symbols for winning combinations after the gaming system initially generated the symbols and before the gaming system changes the behavior of any symbols. The gaming system may evaluate the displayed symbols at predetermined intervals during a play of the game.

Figure 3D:
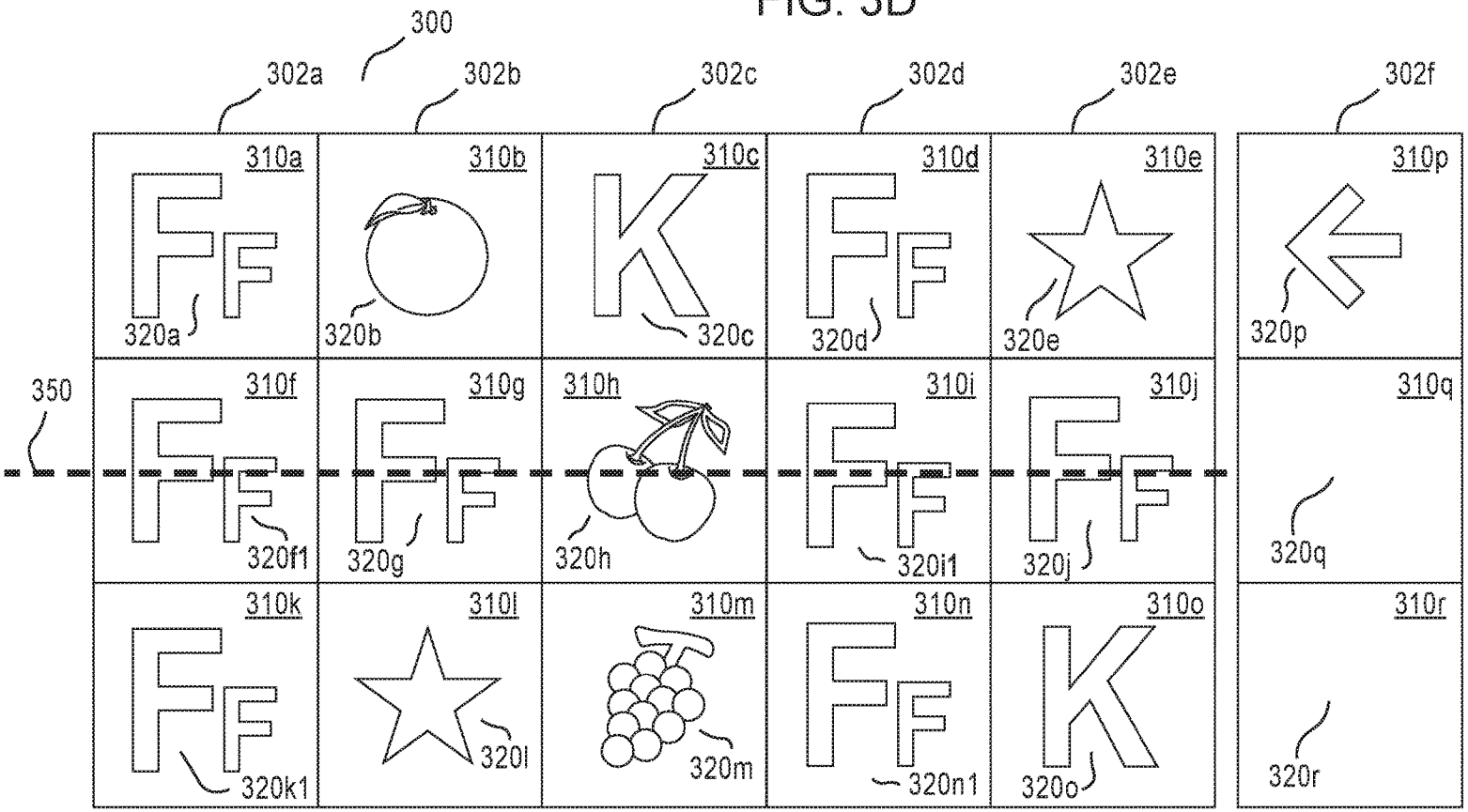

FIG. 3D illustrates one embodiment of the gaming system executing an evaluation of the displayed symbol combinations for winning symbol combinations. As noted above, the player may have wagered on one or more pay lines, which will then be evaluated for winning symbol combinations. Any suitable number of pay lines may be used to evaluate winning symbol combinations. While FIG. 3D shows a single horizontal pay line for evaluation, other figures in the disclosure illustrate some of the many alternative pay line evaluations that are possible.

In the embodiment illustrated in FIG. 3D, the gaming system evaluated one winning pay line across a horizontal direction of symbol display areas including symbol display areas 310*f*, 310*g*, 310*h*, 310*i*, and 310*j*. In this embodiment, five cherry symbols across a pay line results in a winning symbol combination. While only one cherry symbol 320*n* is present across the second row of reels 302*a*-302*e*, the Flipside Frenzy symbols take on the characteristics of the cherry symbol 320*n*. Thus, symbols 320*f*1, 320*g*, 320*h*, 320*i*1, and 320*j* would be evaluated as all cherry symbols for purposes of the gaming system determining winning symbol combinations.

The winning pay line is illustrated as pay line 350 in FIG. 3D across the winning row of reels 302*a*-302*e*. Based on the winning symbol combination along the pay line 350, the gaming system awards the appropriate number of credits to the player and updates the player's credit meter to reflect the winnings. The gaming system may display the number of winning credits and may display the player's total credit balance in a display of the gaming system.

The player may continue the gaming session by playing another game. That is, the player may place a wager and start a new play of the game as noted above. However, continued game play is dependent of the number of credits the player has in the player's credit balance. The player may also choose the cash out. In such an instance, the gaming system provides the player a value based on the player's credit balance using any of the value items discussed above (bills, coins, vouchers, etc.)

It should be noted that prior to the addition of the Flipside Frenzy symbols 320*f*1 and 320*i*1, no symbol combinations were present on any pay lines that would have formed a winning symbol combination from the initially generated symbols on reels 302*a*-302*e* (as illustrated in FIG. 3A). However, the game resulted in a winning symbol combination for the player due to the modification symbol 320*p* and the appearance of Flipside Frenzy symbol in the indicated row to change the other visible symbols on reels 302*a* and 302*d*.

It should be appreciated that in some embodiments, the gaming system may be configured to evaluate the winning symbol combinations before, during, or after the Flipside Frenzy symbols cause the other symbols to change. If the gaming system determines that changing the other symbols to Flipside Frenzy symbols would result in a worse outcome than the outcome from the initially generated and displayed symbols, the gaming system may not cause the other symbols to change to Flipside Frenzy symbols as discussed above. In some embodiments, the gaming system may prevent the other symbols from being altered. In other embodiments, the gaming system may alter the other symbols to Flipside Frenzy symbols, but then revert the altered symbols to the originally generated symbols when the originally generated symbols would produce a better winning combination of symbols. In yet other embodiments, the gaming system may enable to player to select either the initially generated and displayed symbol combination or the displayed symbol combination altered with Flipside Frenzy symbols. In such an embodiment, the gaming system would evaluate the player selected displayed symbol combination for purposes of determining winning symbol combinations. In one other such embodiment, the gaming system may determine that altering the other symbols to Flipside Frenzy symbols will not produce a better winning combination (or will produce a worse game outcome for the player) and lets the player choose either the initially generated and displayed symbol combination or the displayed symbol combination altered with Flipside Frenzy symbols prior to displaying the displayed symbol combination altered with Flipside Frenzy symbols.

Figure 8:
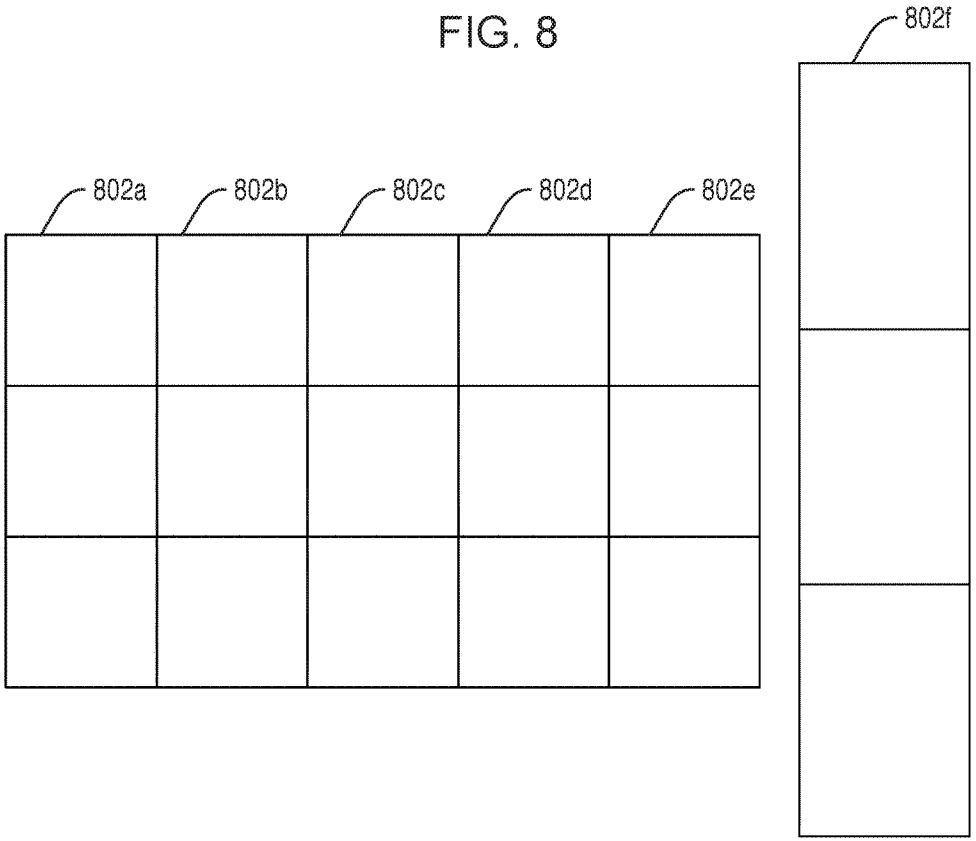
FIG. 8 illustrates a screen shot of an example embodiment of a gaming system having an alternative row modifying reel.

In some embodiments, reel 302*f* may be formed as a reel that is a different size or a different shape from the reel 302*f* illustrated in the figures. In one such embodiment, as illustrated in FIG. 8, reel 802*f* is taller than reels 802*a*-802*e*, such that the top of reel 802*f* extends above the tops of reels 802*a*-802*e*. In another embodiment, the bottom of reel 802*f* extends below the bottoms of reels 802*a*-802*e*. In some embodiments, the top of reel 802*f* extends above the tops of reels 802*a*-802*e* and the bottom of reel 802*f* extends below the bottoms of reels 802*a*-802*e*.

Figure 9:
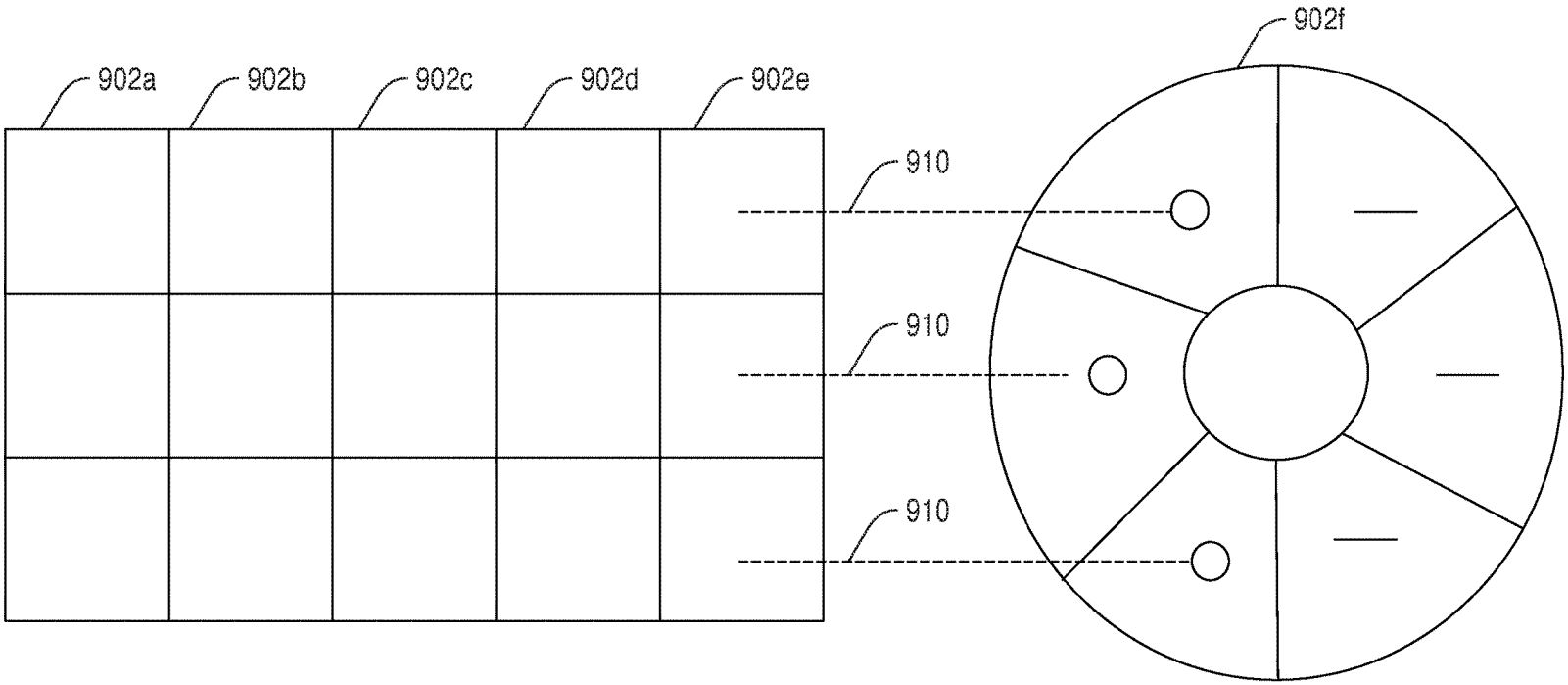
FIG. 9 illustrates a screen shot of an example embodiment of a gaming system having another alternative row modifying reel.

In another embodiment, reel 302*f* is a circle or a wheel. In one example embodiment where reel 302*f* is a circle or wheel, a circle or wheel 902*f* is divided into a suitable number of equal slices, wherein each slice represents a symbol display area as illustrated FIG. 9. The symbol display areas (and the symbols in the symbol display areas) of the circle or wheel may rotate while reels 902*a*-902*e* spin during a play of a game. In one embodiment, the symbols in the symbol display areas of the circle or wheel that are positioned closest to the reels 902*a*-902*e* are each associated with one of the rows of the reels 902*a*-902*e* and perform a similar row indicating or pointing function that symbols in symbol display areas of reel 902*f* perform. The dotted lines 910 represent the row indicated by symbols in the symbol display areas of the circle or wheel.

Figure 4A:
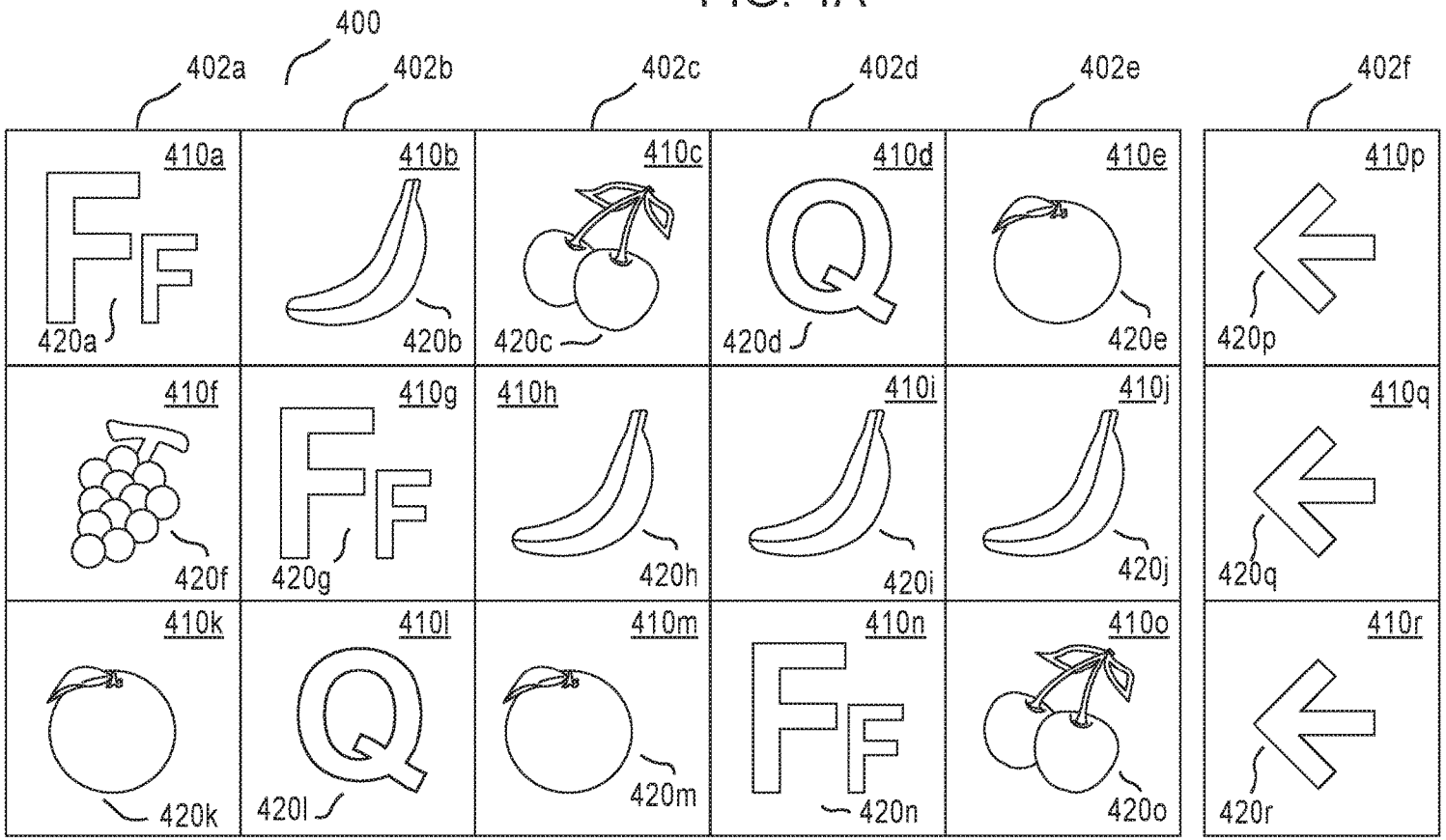
FIGS. 4A, 4B, and 4C illustrate screen shots of another example embodiment of a gaming system having a row modifying reel and a plurality of modifying symbols.
Figure 4B:
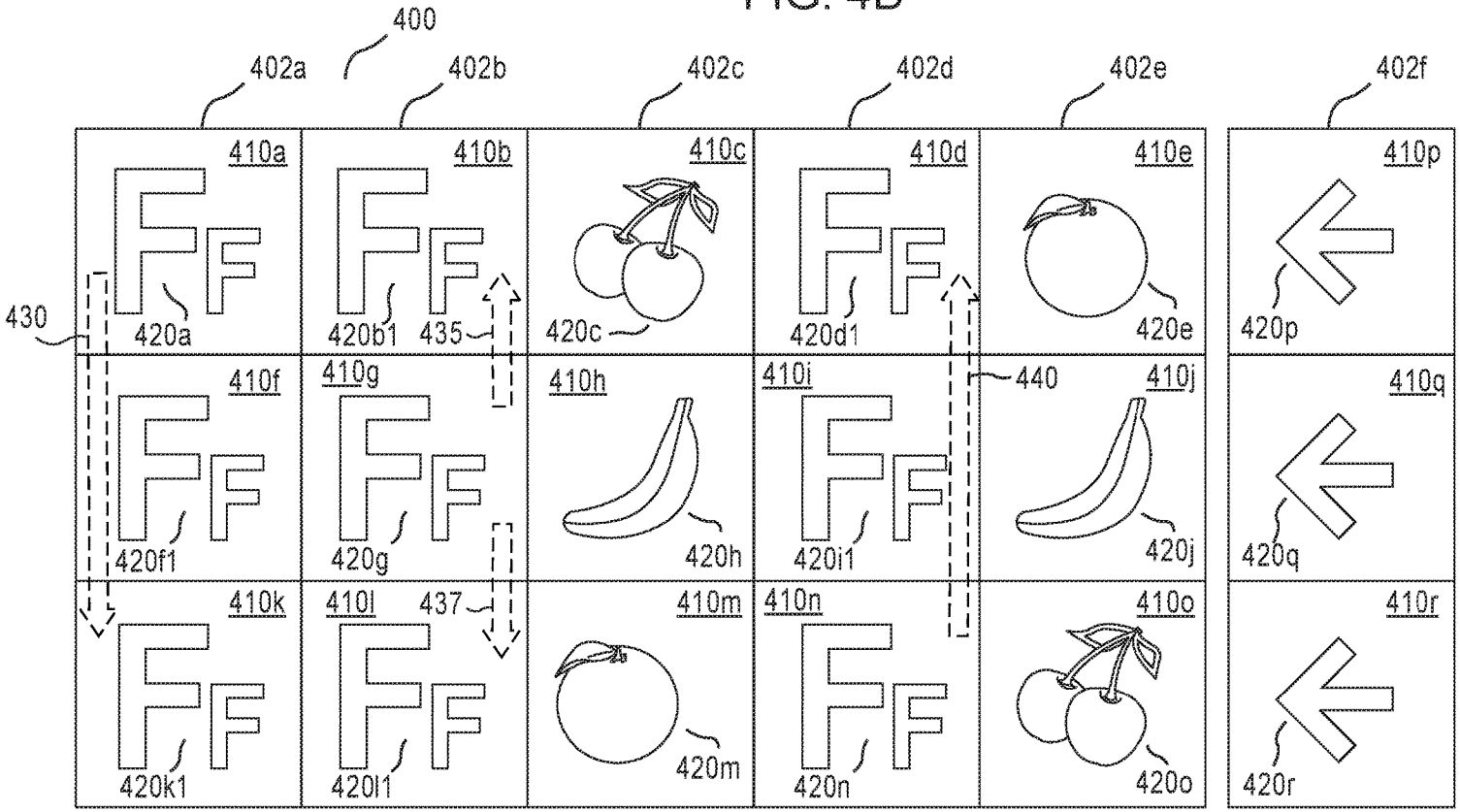
Figure 4C:
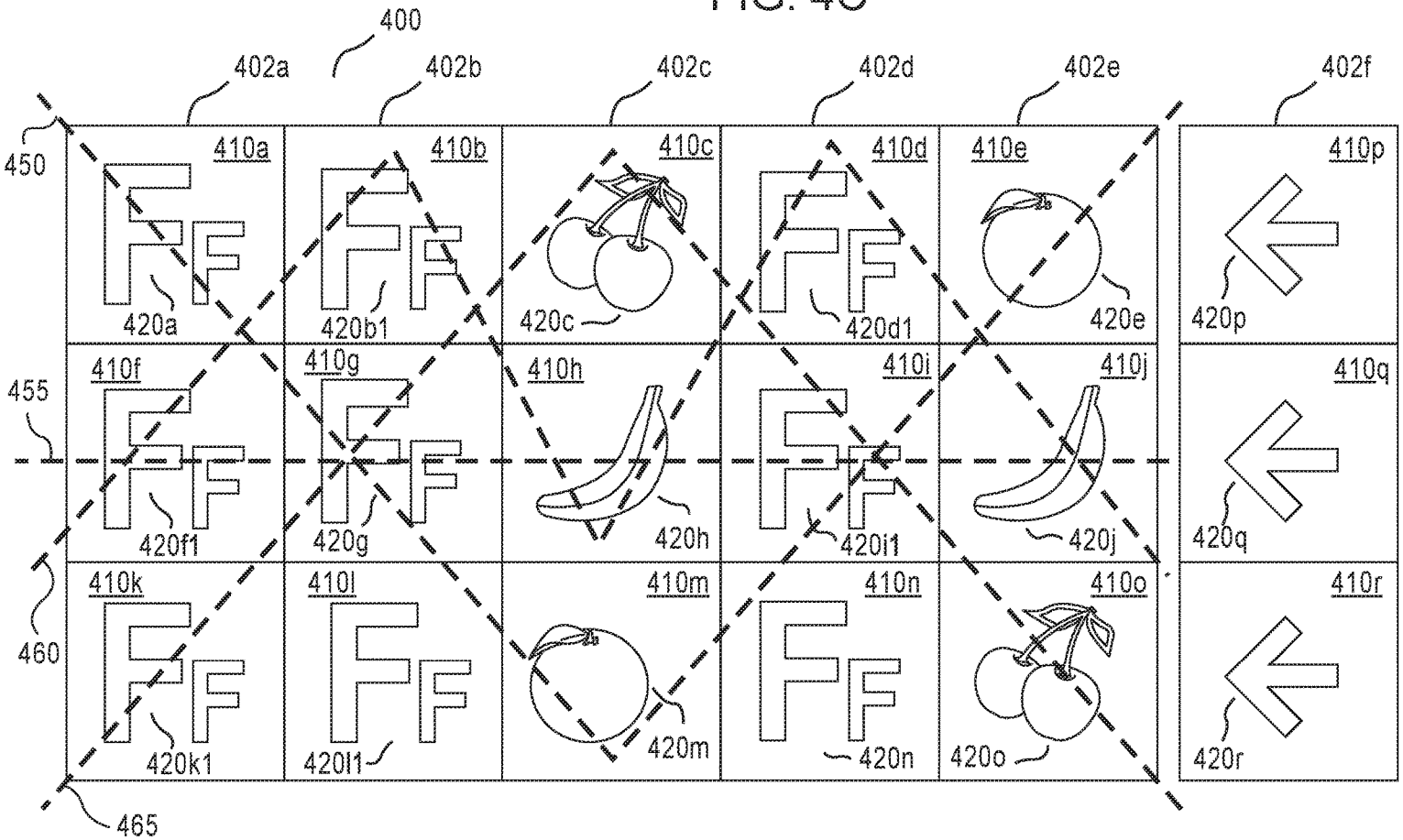

FIGS. 4A, 4B, and 4C illustrate screen shots of one embodiment of a gaming system having a row modifying reel and a plurality of modifying symbols. In some embodiments, the gaming system will generate a plurality of modifying symbols for each play of a game. For example, the player is in a free spin game or the player has entered a bonus game. In other embodiments, the gaming system may generate a plurality of modifying symbols in a base game.

In FIG. 4A the player has wagered on a play of a game and the gaming system executed a game in a manner similar to the process discussed in connection with FIGS. 3A-3D. As illustrated in FIG. 4A, the gaming system shows a display of a plurality of symbols from a first set symbols on reels 402*a*-402*e* and a second set of symbols on reel 402*f*. The gaming system randomly generated the symbols and displayed the symbols as previously described. Stopped reels 402*a*-402*f* contains symbols 420*a*-420*r* in symbol display areas 410*a*-410*r*, respectively. As also illustrated in FIG. 4A, stopped row modification reel 402*f* displays a plurality of modifying symbols in symbol display areas 420*p*-420*r*.

As illustrated in FIG. 4A, the gaming system randomly generated and displayed symbols 420*a*, 420*f*, and 420*k* in symbol display area 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*. The gaming system further randomly generated and displayed symbols 420*p*, 420*q*, and 420*r* in symbol display area 410*p*, 410*q*, and 410*r* for reel 402*f*

As also illustrated in FIG. 4A, the gaming system generated and displayed Flipside Frenzy symbols (420*a*, 420*g*, 420*n*) among other symbols in reels 402*a*, 402*b*, and 402*d*. The gaming system also generated and displayed an arrow or pointer symbol 420*p*, 420*q*, and 420*r* for reel 402*f*. It should be appreciated that the displayed symbol combinations are merely for explanatory purposes and the gaming system may randomly generate any suitable combination of symbols based on defined symbol sets.

FIG. 4B illustrates one embodiment of the gaming system performing an evaluation of the generated symbols on reels 402*a*-402*f* and executing game functions to change behaviors of symbols based on an indicated row of symbols. The gaming system determines that modifying symbol 420*p* was generated and displayed in position 410*p* of reel 402*f*. The gaming system determines that modifying symbol 420*q* was generated and displayed in position 410*q* of reel 402*f*. The gaming system also determines that modifying symbol 420*r* was generated and displayed in position 410*r* of reel 402*f*. Modifying symbols 420*p*, 420*q*, and 420*r* are arrow graphics that indicate or point to all three rows of the visible symbols on reels 402*a*-402*e*. This row indication provides a clear acknowledgment to a player that the gaming system may evaluate and possibly execute game functions on all three rows of the visible symbols on reels 402*a*-402*e*. In one embodiment, the gaming system evaluates (such as using processor 202) each row of the visible symbols on reels 402*a*-402*e* and determines that a Flipside Frenzy symbol 420*a* is visible in symbol display area 410*a*, a Flipside Frenzy symbol 420*g* is visible in symbol display area 410*g*, and a Flipside Frenzy symbol 420*n* is visible in symbol display area 410*n*. In this embodiment, the appearance of a Flipside Frenzy symbol in the indicated row triggers or otherwise causes the gaming system to change the behavior of symbols around the Flipside Frenzy symbols as noted with respect to FIG. 3A-3D.

In the embodiment illustrated in FIG. 4B, the gaming system causes the Flipside Frenzy symbols 420*a*, 420*g*, and 420*n* to expand in the direction of dotted arrows 430, 435, 437 and 440 to the remaining visible symbols display areas on reels 402*a*, 402*b*, and 402*d*. As is illustrated in FIG. 4B, a Flipside Frenzy symbol 420*f*1 has expanded to symbol display area 410*f* on reel 402*a* and replaced the prior symbol 420*f*; a Flipside Frenzy symbol 420*k*1 has expanded to symbol display area 410*k* on reel 402*a* and replaced the prior symbol 420*k*. Similarly, Flipside Frenzy symbols 420*b*1 and 420*l*1 have expanded to symbol display areas 410*b* and 410*l* on reel 402*b* and replaced the prior symbols 420*b* and 420*l*. Likewise, a Flipside Frenzy symbol 420*i*1 and 420*d*1 have expanded to symbol display areas 410*i* and 410*d* on reel 402*d* and replaced the prior symbols 420*i* and 420*d*.

In FIG. 4C, if the gaming system determines that no other symbols are affected by the row indication from symbols 420*p*, 420*q*, and 420*r*, the gaming system evaluates the displayed symbol combinations for winning symbol combinations. FIG. 4C illustrates one embodiment gaming system executing an evaluation of the displayed symbol combinations for winning symbol combinations. As noted above, the player may have wagered on one or more pay lines, which can be evaluated for winning symbol combinations. In the embodiment illustrated in FIG. 4C, the player wagered on at least four different pay lines 450, 455, 460, and 465. As noted above, the gaming system can be configured to enable a player to wager on any suitable number of pay lines and thus evaluate any suitable number of winning symbol combinations along the pay lines.

In the embodiment illustrated in FIG. 4C, the gaming system evaluated pay line 450 that combines symbols 420*a*, 420*g*, 420*m*, 410*i*1, and 420*e* for a winning symbol combination of five Oranges. As noted above, the Flipside Frenzy symbols mimics other symbols. In the illustrated embodiment, the Flipside Frenzy symbols mimics the Orange symbol 420*m* to produce the winning combination along pay line 450. The gaming system evaluated pay line 455 that combines symbols 410*f*1, 410*g*, 410*h*, 410*i*1, and 410*j* for a winning symbol combination of five Bananas. The gaming system evaluated pay line 460 that combines symbol 410*f*1, 410*g*, 410*h*, 410*i*1, and 410*j* for a winning symbol combination of five Bananas. The gaming system evaluated pay line 465 that combines symbol 410*k*1, 410*g*, 410*c*, 410*i*1, and 410*o* for a winning symbol combination of five Cherries.

Based on the winning symbol combination along the pay lines 450, 455, 460, and 465, the gaming system awards the appropriate number of credits to the player and updates the player's credit meter to reflect the winnings. The gaming system may display the number of winning credits and may display the player's total credit balance in a display of the gaming system.

The player may continue the gaming session by playing another game as discussed above. However, continued game play is dependent of the number of credits the player has in the player's credit balance. If not enough credits are available in the player's credit balance, the game system may enable the player to insert additional value to replenish the player's credit balance. The player may also choose to cash out. In such an instance, the gaming system provides the player a value based on the player's credit balance using any of the value items discussed above (bills, coins, vouchers, etc.).

Figure 5A:
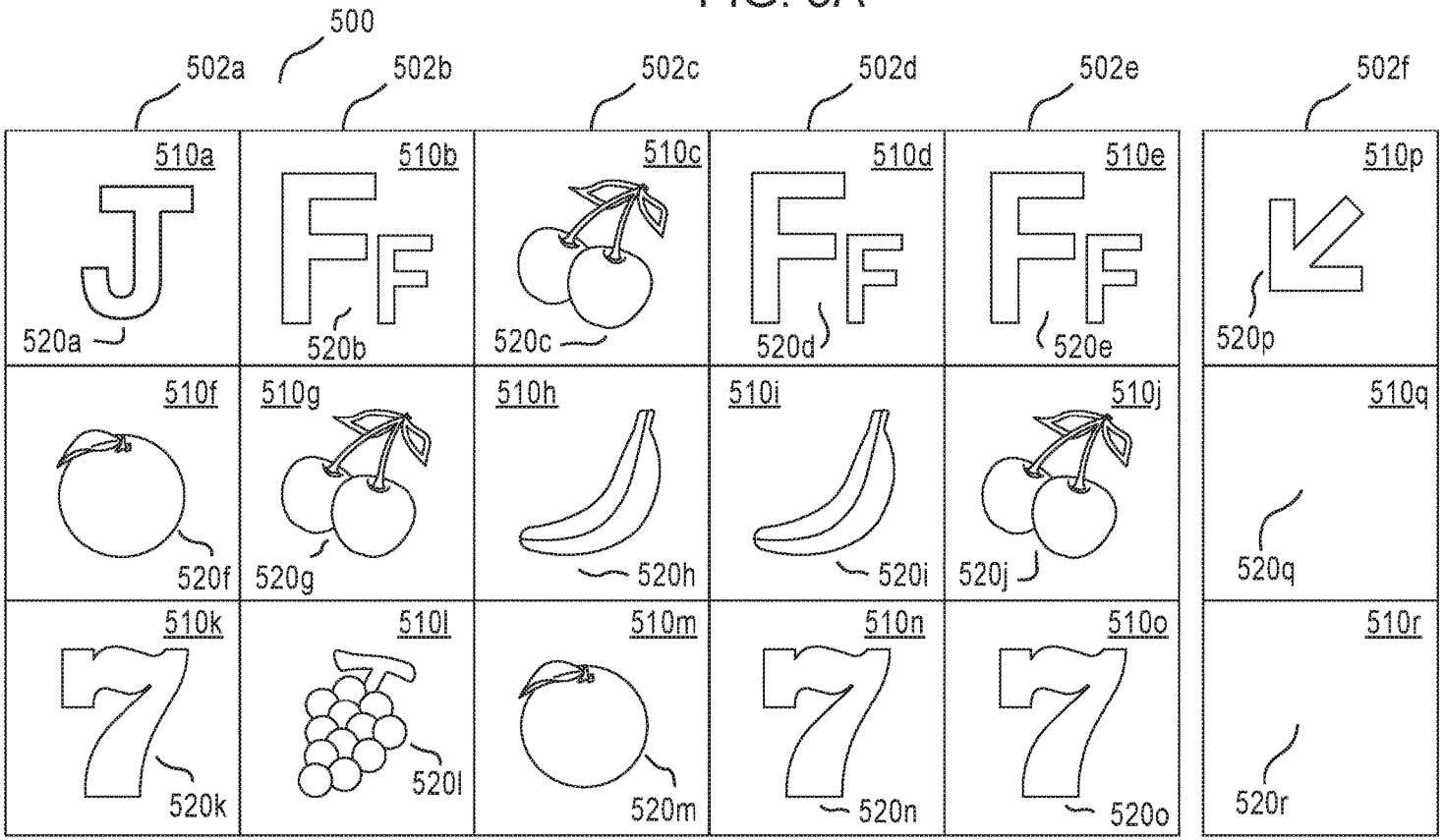
FIGS. 5A, 5B, and 5C illustrate screen shots of another example embodiment of a gaming system having a row modifying reel and one or more modifying symbols, wherein the modifying symbols can indicate rows of symbols at angles different from rows indicated in FIGS. 3A-3D and FIGS. 4A-4C.
Figure 5B:
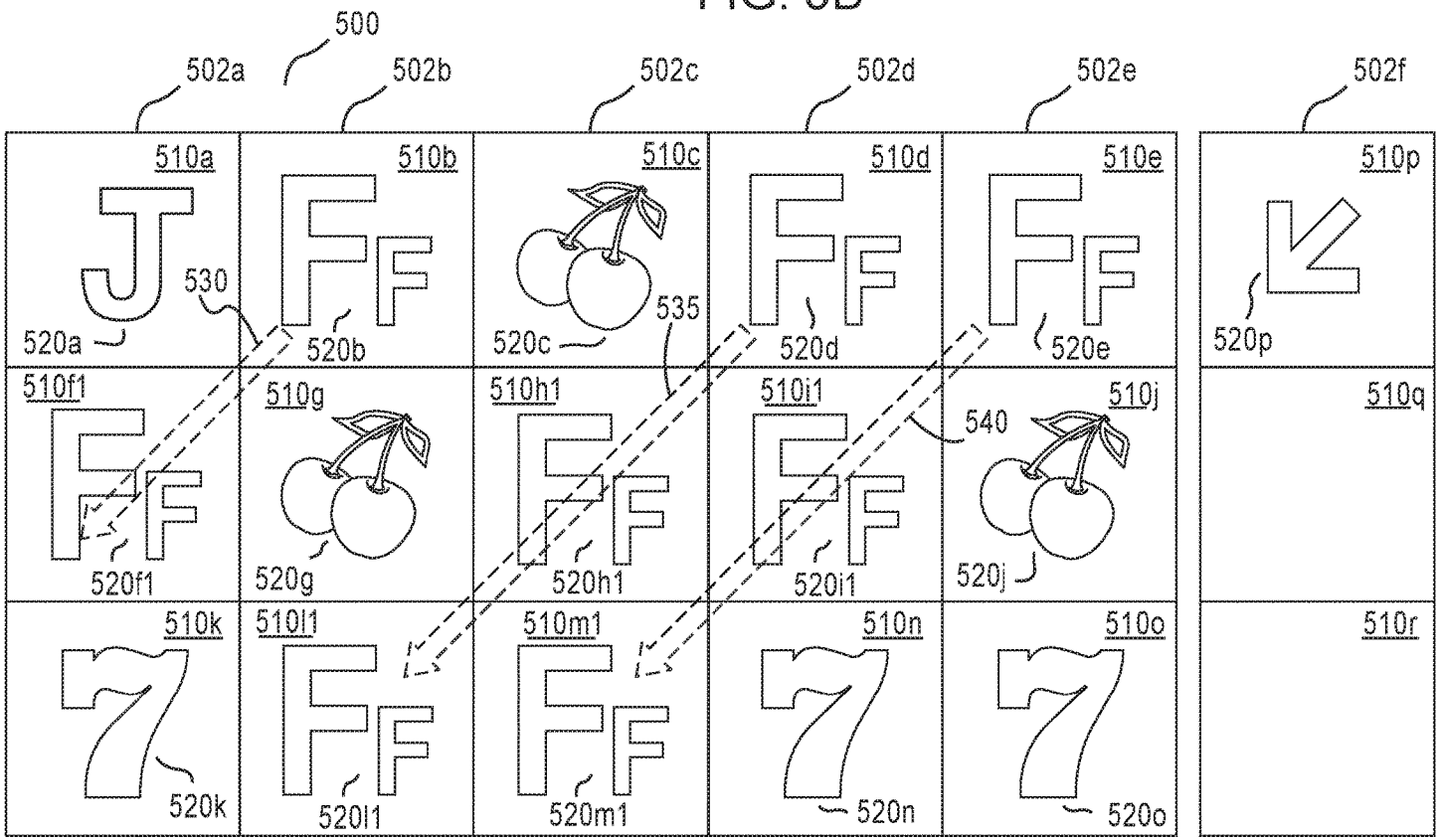
Figure 5C:
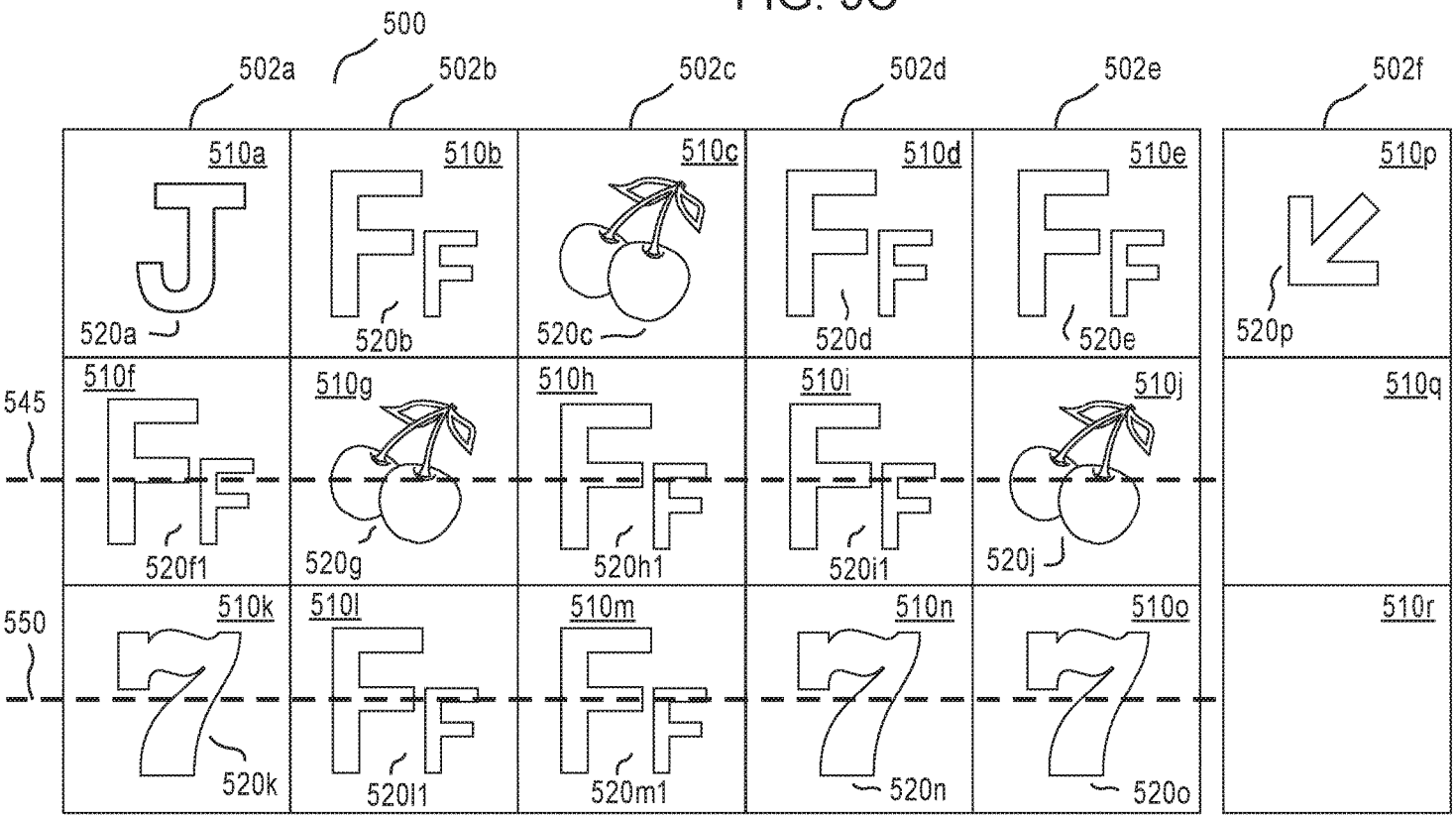

FIGS. 5A, 5B, and 5C illustrate screen shots of another embodiment of a gaming system having a row modifying reel and one or more modifying symbols.

FIGS. 5A, 5B, and 5C illustrate screen shots of one embodiment of a gaming system having a row modifying reel and a plurality of modifying symbols. In some embodiments, the gaming system will generate modifying symbols in reel 502*f* that indicate certain angles or diagonal rows of the symbols generated on reels 502*a*-502*e*, as opposed to just the horizontal rows indicated in FIGS. 3A-3D and FIGS. 4A-4C. In some embodiments, the second set of symbols includes only angled modifying symbols or only horizontal modifying symbols. In other embodiments, the different types of modifying symbols can be combined for random generation and display on reel 502*f* It should also be appreciated that any other types of directional modifying symbols can be used.

In FIG. 5A the player has wagered on a play of a game and the gaming system executed the game in a manner similar to the process discussed above. As illustrated in FIG. 5A, the gaming system shows a display of a plurality of symbols from a first set symbols on reels 502*a*-502*e* and a second set of symbols on reel 502*f*. The gaming system randomly generated the symbols and displayed the symbols as previously described. Stopped reels 502*a*-502*f* contains symbols 520*a*-520*r* in symbol display areas 510*a*-510*r*, respectively. As also illustrated in FIG. 5A, stopped row modification reel 502*f* displays a plurality of modifying symbols in symbol display areas 520*p*-520*r*.

As illustrated in FIG. 5A, the gaming system randomly generated and displayed symbols 520*a*, 520*f*, and 520*k* in symbol display area 510*a*, 510*f*, and 510*k* for reel 502*a* from the first set of symbols. The gaming system also randomly generated and displayed symbols 520*b*, 520*g*, and 520*l* in symbol display areas 510*b*, 510*g*, and 510*l* for reel 502*b*; symbols 520*c*, 520*h*, and 520*m* in symbol display areas 510*c*, 510*h*, and 510*m* for reel 502*c*; symbols 520*d*, 520*i*, and 520*n* in symbol display area 510*d*, 510*i*, and 510*n* for reel 502*d*; symbols 520*e*, 520*j*, and 520*o* in symbol display area 510*e*, 510*j*, and 510*o* for reel 502*e*, all from the first set of symbols. The gaming system further randomly generated and displayed symbols 520*p*, 520*q*, and 520*r* in symbol display area 510*p*, 510*q*, and 510*r* for reel 502*f* from the second set of symbols.

As also illustrated in FIG. 5A, the gaming system generated and displayed Flipside Frenzy symbols (520*b*, 520*d*, 520*e*) among other symbols in reels 502*b*, 502*d*, and 502*e*. The gaming system also generated and displayed an angled arrow or pointer symbol 520*p* for reel 502*f*. It should be appreciated that the displayed symbol combinations are merely for explanatory purposes and the gaming system may randomly generate any suitable combination of symbols based on defined symbol sets.

FIG. 5B illustrates one embodiment of the gaming system performing an evaluation of the generated symbols on reels 502*a*-502*f* and executing game functions to change behaviors of symbols based on the indicated row of symbols. The gaming system determines that modifying symbol 520*p* was generated and displayed in position 510*p* of reel 502*f*. Modifying symbols 520*p* is a directional arrow graphic that indicates, identifies, or otherwise points to a direction at which the gaming system may evaluate and possibly execute game functions on certain rows of the visible symbols on reels 502*a*-502*e*. In previously discussed embodiments, the gaming system evaluated symbols in the horizontal direction indicated by the modifying symbol. In the illustrated embodiment of FIG. 5B, the gaming system evaluates symbols in the same row as the modifying symbol 520*p*, but determines which symbols will behave differently based on the indicated direction of the modifying symbol 520*p*. In the illustrated embodiment of FIG. 5B, the modifying symbol 520*p* points in a diagonal direction and thus the gaming system will alter symbols, if appropriate in the diagonal direction. As with prior embodiments, the gaming system evaluates (such as using processor 202) the indicated row of the visible symbols on reels 502*a*-502*e* and determines that a Flipside Frenzy symbol 520*b* is visible in symbol position 510*a*, a Flipside Frenzy symbol 520*d* is visible in symbol position 510*d*, and a Flipside Frenzy symbol 520*e* is visible in symbol position 510*e*. In this embodiment, the appearance of a Flipside Frenzy symbol in the indicated row triggers or otherwise causes the gaming system to change the behavior of symbols around the Flipside Frenzy symbols as noted by the diagonal direction of indicated by modifying symbol 520*p*. However, the gaming system can modify behaviors of symbols as noted in connections with other embodiments.

In the embodiment illustrated in FIG. 5B, the gaming system causes the Flipside Frenzy symbols 520*b*, 520*d*, and 520*e* to expand in the direction of dotted arrows 530, 535, and 540 to the visible symbols positions on reels 502*a*, 502*b*, 502*c*, and 502*d*. As is illustrated in FIG. 5B, a Flipside Frenzy symbol 520*f*1 has expanded to symbol position 510*f* on reel 502*a* and replaced the prior symbol 520*f*; a Flipside Frenzy symbol 52011 has expanded to symbol position 510*l* on reel 502*b* and replaced the prior symbol 520*l*; Flipside Frenzy symbols 520*h*1 and 520*m*1 have expanded to symbol positions 510*h* and 510*m* on reel 502*c* and replaced the prior symbols 520*h* and 520*m*; and a Flipside Frenzy symbol 520*i*1 has expanded to symbol position 510*i* on reel 502*d* and replaced the prior symbol 520*i*.

In FIG. 5C, if the gaming system determines that no other symbols are affected by the row indication from symbol 520*p*, the gaming system evaluates the displayed symbol combinations for winning symbol combinations. FIG. 5C illustrates one embodiment gaming system executing an evaluation of the displayed symbol combinations for winning symbol combinations. As noted above, the player may have wagered on one or more pay lines, which can be evaluated for winning symbol combinations. In the embodiment illustrated in FIG. 5C, the player wagered on at least two different pay lines 545 and 550. As noted above, the gaming system can be configured to enable a player to wager on any suitable number of pay lines and thus evaluate any suitable number of winning symbol combinations along the pay lines.

In the embodiment illustrated in FIG. 5C, the gaming system evaluated pay line 545 that combines symbols 520*f*1, 520*g*, 520*h*1, 520*i*1, and 520*j* for a winning symbol combination of five Cherries. As noted above, the Flipside Frenzy symbols mimics other symbols for winning symbol combination evaluation purposes. In the illustrated embodiment, the Flipside Frenzy symbols mimics the Cherry symbols 520*g* and 520*j* to produce the winning combination along pay line 545. The gaming system also evaluated pay line 550 that combines symbols 510*k*, 510*l*1, 510*m*1, 510*n*, and 510*o* for a winning symbol combination of five Sevens.

Based on the winning symbol combination along the pay lines 545 and 550, the gaming system awards the appropriate number of credits to the player and updates the player's credit meter to reflect the winnings. The gaming system may display the number of winning credits and may display the player's total credit balance in a display of the gaming system. In some embodiments, the gaming system may also execute other game functions (e.g., the game functions associated with the Flipside Frenzy symbol discussed above) and reevaluate the generated symbols for winning symbol combinations.

The player may continue the gaming session by playing another game as discussed above. However, continued game play is dependent of the number of credits the player has in the player's credit balance. If not enough credits are available in the player's credit balance, the game system may enable the player to insert additional value to replenish the player's credit balance. The player may also choose to cash out. In such an instance, the gaming system provides the player a value based on the player's credit balance using any of the value items discussed above (bills, coins, vouchers, etc.)

Figure 6A:
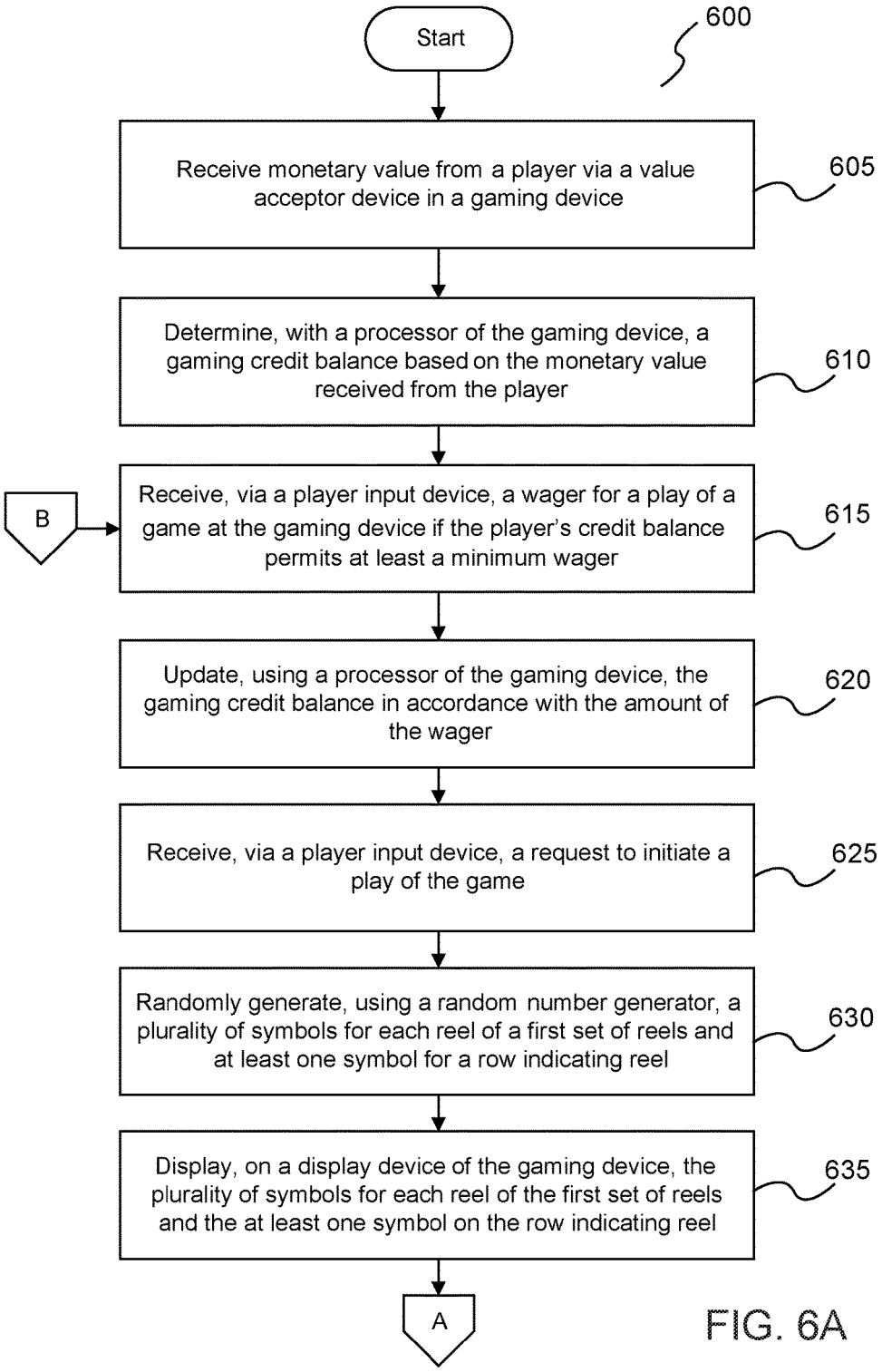
FIGS. 6A and 6B illustrate one embodiment of a method of operating the gaming system.
Figure 6B:
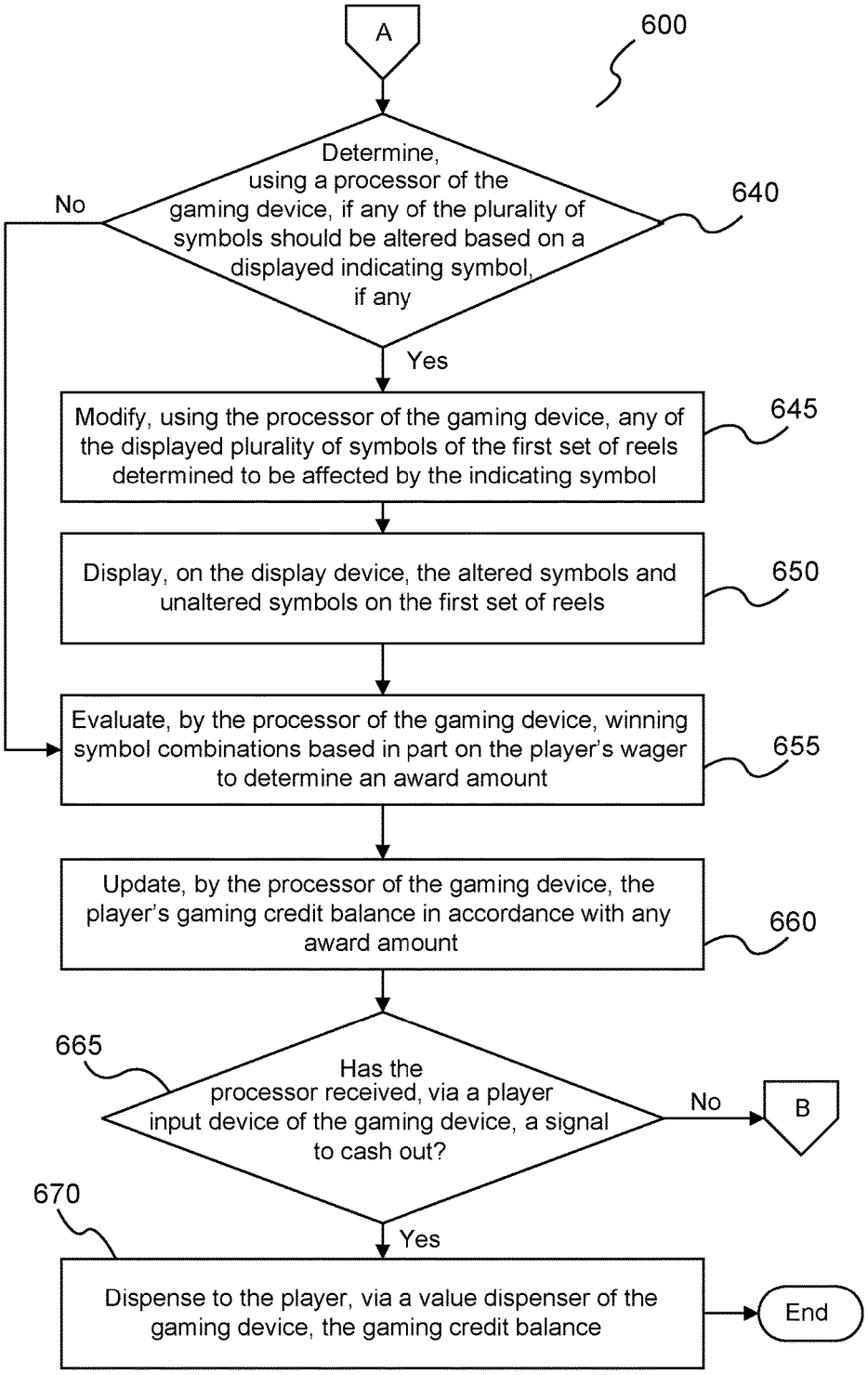

FIGS. 6A and 6B illustrate a flowchart of an example operation 600 of one embodiment of the gaming system and method. In one embodiment, a processor may be configured via instructions stored in a memory device, to perform the operation 600. However, it should be appreciated that other suitable variations of operation 600 are possible. For example, in one embodiment, fewer or one or more additional steps (not shown) may be employed in operation 600 of the gaming system and method.

FIG. 6A illustrates one embodiment in which the gaming system receives a monetary value from a player to initiate operation 600. As indicated in block 605, the gaming system may receive monetary value via a value acceptor device associated with the gaming system. The value acceptor device may be, in one embodiment, disposed in the gaming system or in communication with the gaming system.

In one embodiment, the gaming system may determine a credit balance based on the monetary value received from the player at a value acceptor device as indicated in block 610. The gaming system may determine, via a processor, a gaming credit balance for the player. The gaming credit balance may be based on the monetary value received from the player at the value acceptor device.

In one embodiment, the gaming system may receive a wager for a play of a game at the gaming device. Block 615 of FIG. 6A illustrates one embodiment where the player's wager may be received via a player input device. The gaming system may allow a player to place a minimum wager, a maximum wager, or any suitable wager amount. Depending on the wager amount, the gaming system may also enable the player to select pay lines across displayed symbols positions on reels in the game. In one embodiment, the gaming system may determine whether the player has provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming device to update a gaming credit balance. The credit balance may be updated in accordance with the player's wager amount as indicated in block 620. Some embodiments, the credit balance is not updated until a later time.

Block 625 illustrates one embodiment in which the gaming system may receive a request to initiate a play of a game. The request to initiate a game play may be received from a player via a player input device. For example, the player may press a spin button on the gaming system to start spinning reels.

In one embodiment, the gaming system may use a random number generator to randomly generate a plurality of symbols for each game reel of a first set of reels as indicated in block 630. In one embodiment, the gaming system may also use a random number generator to randomly generate at least one symbol for a symbol modifying reel as also indicated in block 630. As used herein, the random number generation may refer to pseudo-random or true-random depending on the module used for the random number generation.

In one embodiment, the gaming system may cause a display device to display the plurality of symbols generated for the first set of reels as indicated in block 635. In one embodiment, the gaming system may also cause a display device to display the at least one modifying symbol for a row modifying reel as also indicated in block 635.

Turning now to FIG. 6B and block 640, in one embodiment the gaming system may determine if any of the plurality of symbols are to be altered based on the modifying symbol. The gaming system may use a processor to determine any of the alterations to the symbols in the first set of symbols. In one embodiment, if the gaming system determines that none of the plurality of symbols are to be altered by the modifying symbol, the process of operation flow 600 may proceed directly to the evaluation illustrated in block 655.

In one embodiment, the gaming system may modify any of the plurality of symbols determined in block 640 to be affected by the modifying symbol, as illustrated in block 645. The game system may use a processor of the gaming device to alter any affected symbol as discussed above.

In one embodiment, the gaming system may display on a display device the altered symbols and the unaltered symbols as indicated in block 650.

The gaming system may evaluate, in one embodiment, the game pay lines wagered upon by a player as indicated in block 655. The game system may evaluate pay lines via a processor of the gaming system. In one embodiment, the gaming system determines an award amount based on winning symbol combinations that are formed along a wagered pay line.

Block 660 illustrates one embodiment in which the gaming system may update, by a processor of the gaming system, the gaming credit balance in accordance with any award amount determined in block 655.

The gaming system, in one embodiment, and after receiving a signal to end game play from a player via an input device as illustrated in block 665, dispense to the player via a value dispenser of the gaming system, the gaming credit balance as indicated in block 660. In one embodiment, if the processor has not received, a signal to end game play (e.g., via a player input device), the process of operation flow 600 returns to block 615 to receive a wager for a play of a game at the gaming system. However, in one embodiment, the wager may not be accepted if the player has less credits than the player's selected wager amount.

FIGS. 7A, 7B, 7C, and 7D illustrate screen shots of one embodiment of a gaming system having a plurality of modifying reels and a plurality of modifying symbols. A gaming system may include two or more modifying reels, where different combinations of symbols may trigger the gaming system to execute different game functions, similar to the triggered game functions discussed above in connection with the prior figures having one modifying reel.

Figure 7A:
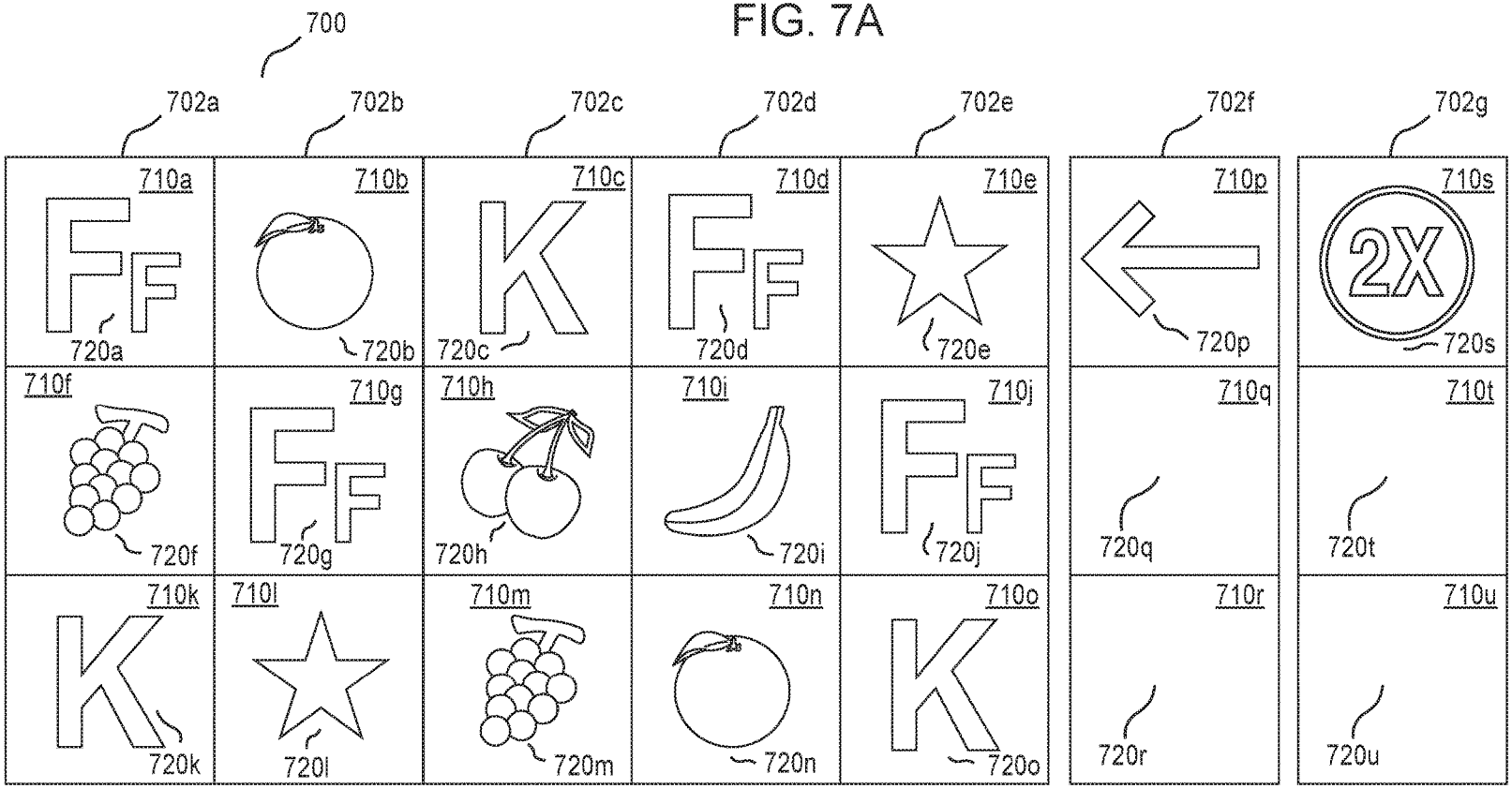
FIGS. 7A, 7B, 7C, and 7D illustrate a screen shots of an example embodiment of a gaming system having a plurality of modifying reels.

As illustrated in FIG. 7A, one embodiment of the gaming system includes two row modifying reels. In one embodiment, a modifying symbol must appear in the same row of each modifying reel before the gaming system is triggered to change the behavior of displayed symbols on a first set of reels. In another embodiment, a modifying symbol may appear in one row of one of the modifying reels to trigger the symbol behavior changes discussed above while a payout multiplier may appear in the other modifying reel to increase the player's winnings. In some embodiments, the gaming system may randomly generate a modifying symbol on one modifying reel without generating another modifying symbol on another modifying reel. In such an embodiment, the gaming system may still execute a game function based on the gaming system generating one modifying symbol on one modifying reel. In another embodiment, a modifying symbol must appear in one row of one of the modifying reels to trigger the symbol behavior change and a payout multiplier must also appear in the other row modifying reel to increase the player's winnings. It should be appreciated that any number and variety of different modifying symbols can be included in the set of modifying symbols generated for the modifying reels. It should also be appreciated that the gaming system may generate different combinations of modifying symbols on one or more modifying reels, where the different combinations of modifying symbols trigger the gaming system to execute different game functions.

FIG. 7A illustrates one embodiment of a game display that is displayed by the gaming system on a display device of the gaming device 100. In one embodiment, game display 700 may be displayed on first display 122 of gaming device 100 illustrated in FIG. 1. However, any other suitable display may be used. The game display 700 displays a set of a plurality of reels 702*a*, 702*b*, 702*c*, 702*d*, 702*e*, 702*f*, and 702*g* as illustrated in FIG. 7A. As also illustrated in FIG. 7A, a first set of reels 702*a*-702*e* are displayed substantially side by side while a second set of reels 702*f* and 702*g* are depicted as separated from reels 702*a*-702*e*. It should be appreciated that reels 702*f* and 702*g* can be displayed substantially side by side with each other in some embodiments. It should be appreciated that reels 702*f* and 702*g* can be displayed substantially side by side with reels 702*a*-702*e* in some embodiments. It should be appreciated that reels 702*a*-702*g* can be displayed with any suitable amount of separation or no separation.

The plurality of reels 702*a*-702*e* are each associated with a first set of symbols, where the first set of symbols includes a plurality of symbols. Each reel 702*a*-702*e* is associated with a plurality of symbols of the first set of symbols. Each reel 702*a*-702*e* can also be associated the same or a different plurality of symbol combinations from the first set of symbols. Reels 702*f* and 702*g* are associated with a second set symbols, where the second set of symbols includes a plurality of modifying symbols. In some embodiments, reels 702*f* and 702*g* may be associated with different sets of symbols and different modifying symbols.

Returning now to FIG. 7A, the game display 700 also depicts a plurality of symbol display areas 710*a*, 710*b*, 710*c*, 710*d*, 710*e*, 710*f*, 710*g*, 710*h*, 710*i*, 710*j*, 710*k*, 710*l*, 710*m*, 710*n*, 710*o*, 710*p*, 710*q*, 710*r*, 710*s*, 710*t*, and 710*u*. These symbol display areas can be associated in a manner that provides the appearance of game reels. As illustrated in FIG. 7A, symbol display areas 710*a*, 710*b*, 710*c*, 710*d*, 710*e*, 710*f*, 710*g*, 710*h*, 710*i*, 710*j*, 710*k*, 710*l*, 710*m*, 710*n*, 710*o* are associated in a manner that provides the appearance of a first set of five game reels. In one embodiment, the plurality of symbol display areas that provide the appearance of five game reels may be arranged in a manner that visibly shows three symbol positions of each of the five game reels. For example, the symbol display areas 710*a*-710*o* are each associated with positions on reels 702*a*-702*e*. The symbol display areas 710*p*-710*r* are associated with positions on modifying reel 702*f*. The symbol display areas 710*s*-710*u* are associated with positions on modifying reel 702*g*. As shown in FIG. 7A, symbol display areas 710*a*, 710*f*, and 710*k* are associated with reel 702*a*; symbol display areas 710*b*, 710*g*, and 710*l* are associated with reel 702*b*; symbol display areas 710*c*, 710*h*, and 710*m* are associated with reel 702*c*; symbol display areas 710*d*, 710*i*, and 710*n* are associated with reel 702*d*; symbol display areas 710*e*, 710*j*, and 710*o* are associated with reel 702*e*; symbol display areas 710*p*, 710*q*, and 710*r* are associated with modifying reel 702*f*, and symbol display areas 710*s*, 710*t*, and 710*u* are associated with modifying reel 702*g*. The arrangement illustrated in the embodiment of FIG. 7A thus creates a visible display area of the reels 702*a*-702*g* comprising three symbol positions for each reel. When viewed together, reels 702*a*-702*e* appear like a 3-row by 5-column reel array in display 700 and reels 702*f* and 702*g* each appear like a 3-row by 1 column reel array the display 700. In other embodiments, smaller or larger visible areas of the reels can be displayed. That is, the reels 702*a*-702*g* may show fewer or a larger numbers of visible symbols. While symbol display areas are illustrated with defined boxes, it should be appreciated that in some embodiments, the defined boxes are not visible to the player.

Each reel 702*a*-702*e* may display a plurality of symbols from the first set of symbols in their respective symbol display areas as illustrated in FIG. 7A. Modifying reels 702*f* and 702*g* may display one or more symbols from the second set symbols in their respective symbol display areas as illustrated in FIG. 7A.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above.

To initiate of a play of a game, the player presses one or more appropriates buttons on the gaming system to deduct credits necessary to play the game and to identify the player's wager. The player's wager may include identifying pay lines or other game features the player wishes to activate in exchange for the wager. The player may also actuate a game start button or a spin button. The gaming system may deduct the appropriate credits from the player's credit balance after the wager or at any suitable time.

Upon receipt of the player's wager and activation of a game start button, the gaming system may show an animation of spinning reels of FIG. 7A for each of the reels 702*a*-702*g*. In one embodiment, the gaming system randomly generates symbols 720*a*-720*u* from the first and second set of symbols for reels 702*a*-702*g*, respectively. As noted above, the gaming system may rely on random number generation performed by a pseudo RNG or a true RNG. The gaming system displays the generated symbols 720*a*-720*u* in symbols display areas 710*a*-710*u* as illustrated in FIG. 7A. Symbols 720*a*-720*u* displayed on reels 702*a*-702*g* illustrate the randomly generated symbols after the reels have stopped spinning.

As illustrated in FIG. 7A, the gaming system randomly generated and displayed symbols 720*a*, 720*f*, and 720*k* in symbol display areas 710*a*, 710*f*, and 710*k* for reel 702*a*. The gaming system also randomly generated and displayed symbols 720*b*, 720*g*, and 720*l* in symbol display areas 710*b*, 710*g*, and 710*l* for reel 702*b*; symbols 720*c*, 720*h*, and 720*m* in symbol display areas 710*c*, 710*h*, and 710*m* for reel 702*c*; symbols 720*d*, 720*i*, and 720*n* in symbol display area 710*d*, 710*i*, and 710*n* for reel 702*d*; symbols 720*e*, 720*j*, and 720*o* in symbol display area 710*e*, 710*j*, and 710*o* for reel 702*e*. The gaming system further randomly generated and displayed symbols 720*p*, 720*q*, and 720*r* in symbol display area 710*p*, 710*q*, and 710*r* for modifying reel 702*f*; and symbols 720*s*, 720*t*, and 720*u* in symbol display area 710*s*, 710*t*, and 710*u* for modifying reel 702*g*.

As illustrated in FIG. 7A, the gaming system generated and displayed Flipside Frenzy symbols (720*a*, 720*d*, 720*g*, 720*j*), orange symbols (720*b*, 720*n*), grape symbols (720*f*, 720*m*), a cherry symbol (720*h*), a banana symbol (720*i*), a K or King symbol (720*c*, 720*k*, 720*o*)), and star symbol (720*e*, 720*l*). The gaming system also generated and displayed an arrow or pointer symbol 720*p* and blank symbols 720*q* and 720*r* for modifying reel 702*f*; and a 2× multiplier symbol 720*s* and blank symbols 720*t* and 720*u* for modifying reel 702*g*. However, is should be appreciated that the displayed symbol combinations are merely for explanatory purposes and the gaming system may randomly generate any suitable combination of symbols based on defined symbol sets.

Figure 7B:
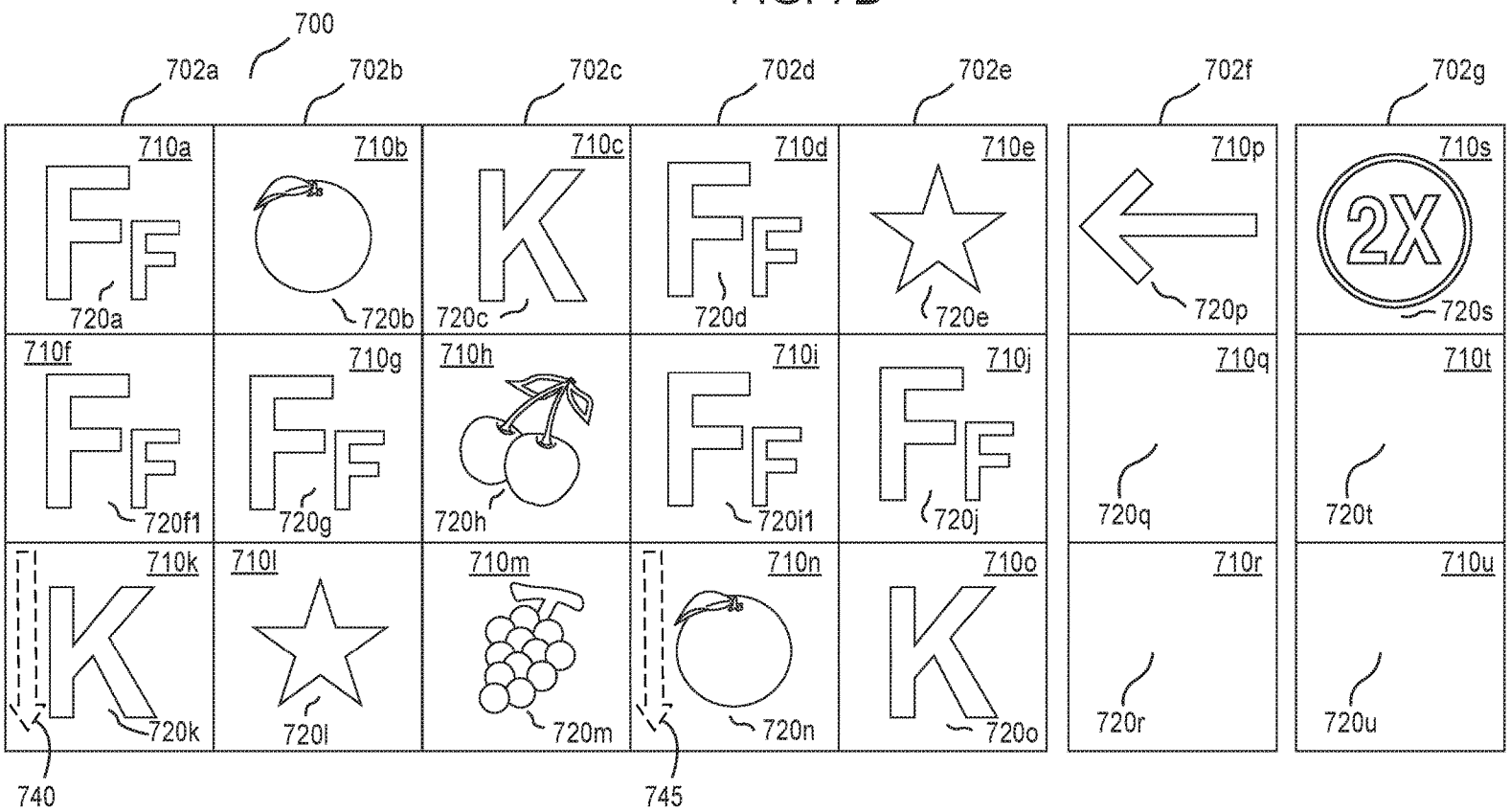

FIG. 7B illustrates one embodiment of the gaming system performing an evaluation of the generated symbols on reels 702*a*-702*f* and executing game functions to change behaviors of symbols based on an indicated row of symbols. The gaming system determines that modifying symbol 720*p* was generated in symbol display area 710*p* of modifying reel 702*f* Modifying symbol 720*p* is an arrow graphic that indicates or points to the first row the visible symbols on reels 702*a*-702*e*. The gaming system also determines that modifying symbol 720*s* was generated in symbol display area 710*s* of reel 702*g*. In this embodiment, because two modifying symbols were generated in the same row across two modifying reels 702*f* and 702*g*, the gaming system determines that the first row across reels 702*a*-702*e* is an indicated row. As noted in previous figures, this row indication provides a clear acknowledgment to a player that the gaming system may evaluate and possibly execute game functions on the first row of the visible symbols on reels 702*a*-702*e*. In one embodiment, if reel 702*g* did not include a generated modifying symbol in symbol display area 710*s*, the gaming system may determine that first row across reels 702*a*-702*e* is not indicated.

As previously noted, in one embodiment, the gaming system may execute a game function (e.g., causing a predetermined symbol to change) if the modifying symbol 720*p* was generated on one modifying reel without requiring that another modifying symbol be generated on any other displayed modifying reel. However, in some embodiments, the gaming system may not execute a game function unless a modifying symbol was generated on both modifying reels (or in some cases on all displayed modifying reels). In some embodiments, the same modifying symbol must be generated on each modifying reel to trigger the gaming system to execute a game function. In some embodiments, different modifying symbols must be generated to trigger the gaming system to execute a game function. In another embodiment, different combinations of generated modifying symbols trigger the gaming system to execute different game functions. In still other embodiments, the gaming system may not execute a game function unless a modifying symbol was generated in the same row of at least two modifying reels (or in some cases, in the same row of each displayed modifying reel). It should be appreciated that any suitable combinations of the foregoing can be made for purposes of triggering execution of a game function. It should be further appreciated that the gaming system may require generation of at least one additional symbol on one of the reels 702*a*-702*e* before executing a game function.

Returning to FIG. 7B, the gaming system evaluates (such as using processor 202) the first row of the visible symbols on reels 702*a*-702*e* and determines that a Flipside Frenzy symbol 720*a* is visible in symbol display area 710*a* and a Flipside Frenzy symbol 720*d* is visible in symbol position 710*d* in the indicated row. In this embodiment, the appearance of Flipside Frenzy symbols in the indicated row triggers or otherwise causes the gaming system to change the behavior of symbols around the Flipside Frenzy symbols.

In the embodiment illustrated in FIG. 7B, the gaming system causes the Flipside Frenzy symbols 720*a* and 720*d* to expand in the direction of dotted arrows 740 and 745 to the remaining visible symbols display areas on reels 702*a* and 702*d*. As is illustrated in FIG. 7B, a Flipside Frenzy symbol 720*f*1 has expanded to symbol display area 710*f* on reel 702*a* and replaced the prior symbol 720*f*. Likewise, a Flipside Frenzy symbol 720*i*1 has expanded to symbol display area 710*i* on reel 702*d* and replaced the prior symbol 720*i*.

While the illustrations in the figures of the disclosure show symbols expanding to other symbol positions and replacing the existing symbols, other transformations may be used in place of the expanding symbols as noted above.

Figure 7C:
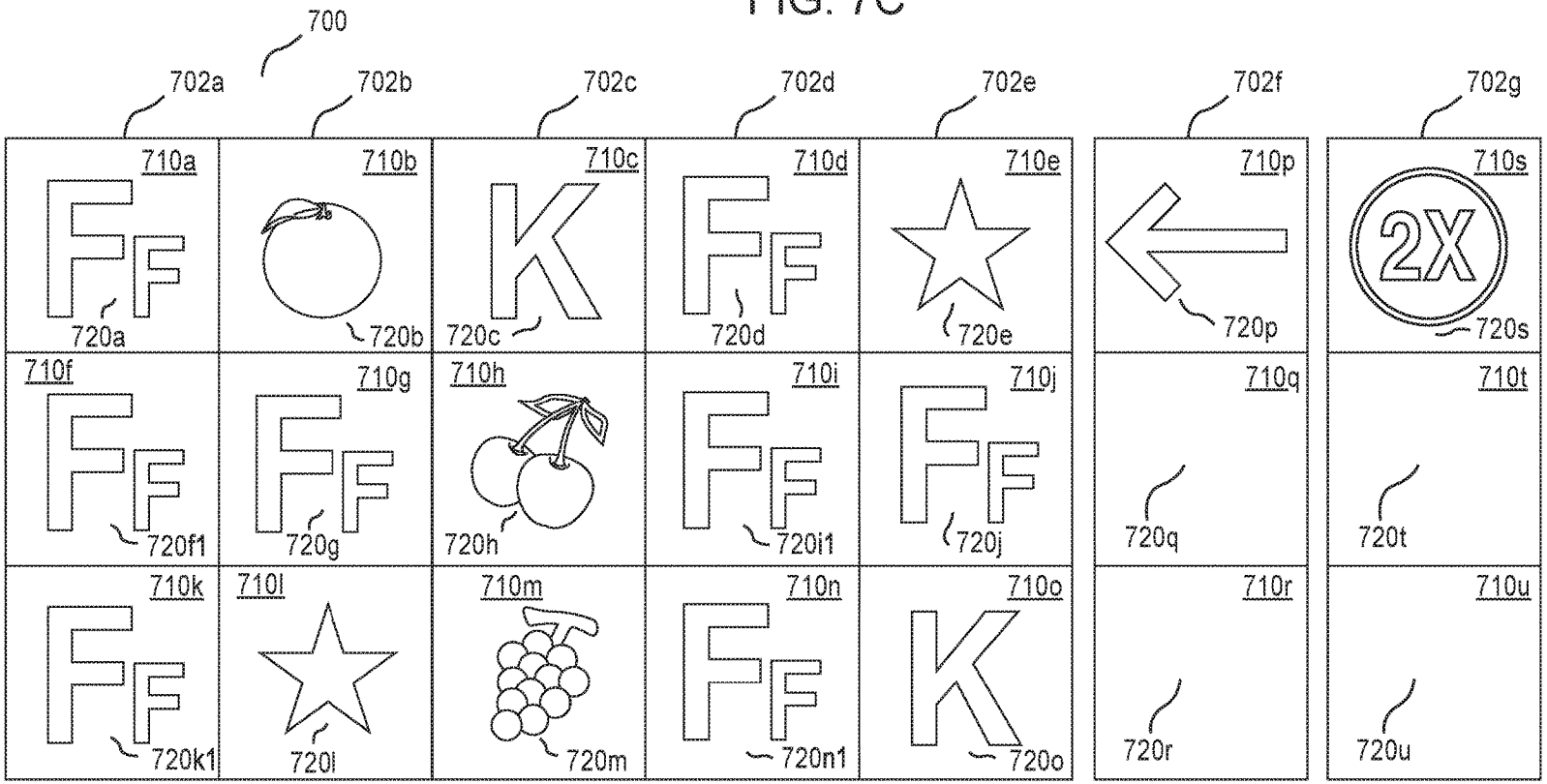

FIG. 7C illustrates a continuation of the gaming system executing game functions to change behaviors of symbols based on an indicated row of symbols as discussed above in FIG. 7B. More specifically, FIG. 7C illustrates one embodiment where the Flipside Frenzy symbols continued to expand to populate entire reels 702*a* and 702*d* with Flipside Frenzy symbols. As is illustrated in FIG. 7C, a Flipside Frenzy symbol 720*k*1 has expanded to symbol display area 710*k* on reel 702*a* and replaced the prior symbol 720*k*. Likewise, a Flipside Frenzy symbol 720*n*1 has expanded to symbol display area 710*n* on reel 702*d* and replaced the prior symbol 720*n*. The expanding symbols may increase the player's anticipation of increased awards and further increase the player's enjoyment of the game.

If the gaming system determines that no other symbols are affected by the row indication from modifying symbols 720*p* and 720*s*, the gaming system evaluates the displayed symbol combinations for winning symbol combinations. It should be appreciated that the gaming system can evaluate the displayed symbols for winning combinations at any time.

Figure 7D:
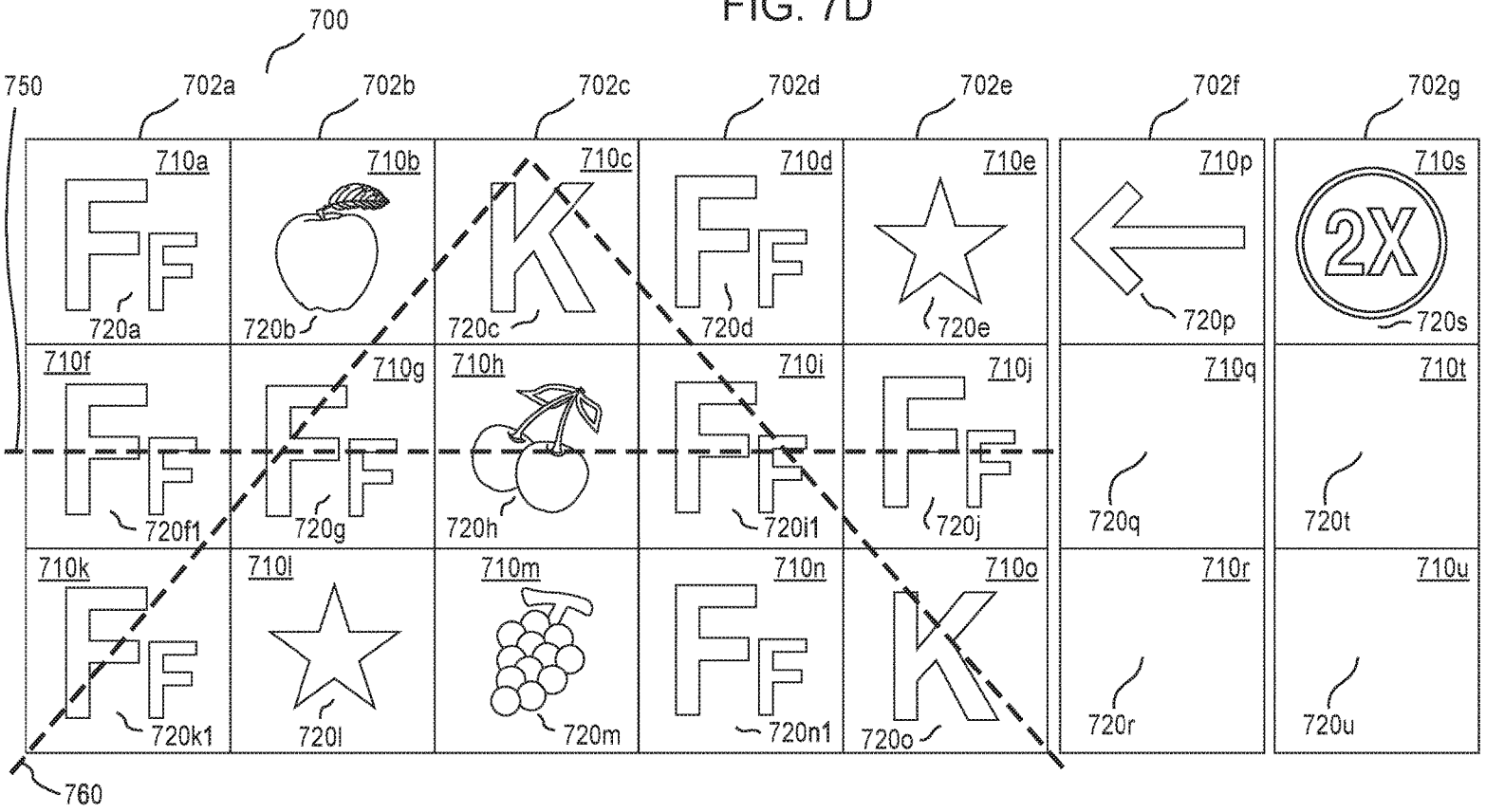

FIG. 7D illustrates one embodiment of the gaming system executing an evaluation of the displayed symbol combinations for winning symbol combinations. As noted above, the player may have wagered on one or more pay lines, which will then be evaluated for winning symbol combinations. Any suitable number of pay lines may be used to evaluate winning symbol combinations. While FIG. 7D shows a single horizontal pay line for evaluation, other figures in the disclosure illustrate some of the many alternative pay line evaluations that are possible.

In the embodiment illustrated in FIG. 7D, the gaming system evaluated two winning pay lines. One winning pay line 750 is across a horizontal direction of symbol display areas including symbol display areas 710*f*, 710*g*, 710*h*, 710*i*, and 710*j*. In this embodiment, five cherry symbols across a pay line results in a winning symbol combination. While only one cherry symbol 720*n* is present across the second row of reels 702*a*-702*e*, the Flipside Frenzy symbols take on the characteristics of the cherry symbol 720*n*. Thus, the gaming system evaluates symbols 720*f*1, 720*g*, 720*h*, 720*i*1, and 720*j* as all cherry symbols for purposes of determining winning symbol combinations. Another winning pay line 760 is across symbol display areas including symbol display areas 710*k*, 710*g*, 710*c*, 710*i*, and 710*o*. In this embodiment, five k or king symbols across a pay line results in a winning symbol combination. While only two k or king symbols 720*c* and 720*o* are present across pay line 760 and reels 702*a*-702*e*, the Flipside Frenzy symbols also take on the characteristics of the k or king symbol. Thus, the gaming system evaluates symbols 720*k*1, 720*g*, 720*c*, 720*i*1, and 720*o* as all k or king symbols for purposes of determining winning symbol combinations.

Based on the winning symbol combination along the pay lines 750 and 760, the gaming system determines an award. In addition, because a 2× multiplier symbol was generated in symbol display area 710*s* on modifying reel 702*g* in the same row as another modifying symbol, the gaming system further multiplies the award calculated from pay lines 750 and 760 by 2 in this embodiment. The gaming system awards the appropriate number of credits to the player and updates the player's credit meter to reflect the final winnings calculation. The gaming system may display the number of winning credits and may display the player's total credit balance in a display of the gaming system.

The player may continue the gaming session by playing another game. That is, the player may place a wager and start a new play of the game as noted above. However, continued game play is dependent of the number of credits the player has in the player's credit balance. The player may also choose the cash out. In such an instance, the gaming system provides the player a value based on the player's credit balance using any of the value items discussed above (bills, coins, vouchers, etc.)

It should be noted that prior to the addition of the Flipside Frenzy symbols 720*f*1, 720*k*1, and 720*i*1, no symbol combinations were present on any pay lines that would have formed a winning symbol combination from the initially generated symbols on reels 702*a*-702*e* (as illustrated in FIG. 7A). However, the game resulted in winning symbol combinations for the player due to the modification symbol 720*p* and the modification symbol 720*s* and the appearance of Flipside Frenzy symbols in the indicated row to change the other visible symbols on reels 702*a* and 702*d*.

It should be appreciated that row modifying reels increase anticipation for game players for the game outcome. Even if no matches are determined after an initial generation of symbols or after an initial spin of a set of game reels, row modifying reels can dramatically alter the winning symbol combinations formed after the initial symbols are displayed.

By pointing to or indicating a row of displayed symbols and then altering symbols in a column based upon a predetermined symbol being present in the indicated row, the gaming system described herein creates a new level of game element interactions within a game. This also adds a new level of anticipation and excitement for game players.

The row modifying reels also increase the amount of screen "real estate" that a game uses on a screen. One problem that game designs face is that the use of larger displays in gaming devices creates a lot of unused space. The unused space can be distracting to players and may cause players to find a gaming system less appealing. Adding the row modifying reels to a gaming system further provides a technical solution to the technical problem of unused display "real estate" created by larger displays.

A number of embodiments of the invention have been described. It should be understood that various modifications may be made without departing from the spirit and scope of the invention. For example, various forms of the flows shown above may be used, with steps re-ordered, added, or removed. Accordingly, other embodiments are within the scope of the following claims.

We claim:

1. A gaming system comprising:

a cabinet;

a processor, a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via an input device, the credit balance being decreased by the wager, cause the display device to display a plurality of symbol display areas including a first symbol display area and a second symbol display area;

cause the display device to display a plurality of randomly determined symbols from a first set of a plurality of symbols in the first symbol display area;

cause the display device to display a second plurality of randomly determined symbols from a second set of symbols in the second symbol display area, the second plurality of randomly determined symbols further comprising at least one modifying symbol;

determine if any of the displayed plurality of randomly determined symbols is a predetermined symbol and if the at least one modifying symbol is horizontally aligned with any predetermined symbol;

alter at least one symbol of the displayed plurality of randomly determined symbols in the first symbol display area into a symbol that is different from the modifying symbol if the predetermined symbol is determined to be displayed and if the at least one modifying symbol is horizontally aligned with the predetermined symbol, wherein the at least one modifying symbol remains displayed;

determine any awards based on the symbols displayed in the first symbol display area and the wager, wherein the award determination is independent of the at least one modifying symbol;

cause the display device to display any determined awards, the credit balance being increased by any determined awards; and issue value from the value dispenser based on the credit balance upon receipt of a cash out signal via the input device.

2. The gaming system of claim 1, wherein the first display area comprises a plurality of reels and the second display area comprises at least one reel and the displayed plurality of randomly determined symbols and the displayed second plurality of randomly determined symbols are displayed on the reels;

wherein the reels are oriented vertically and the displayed symbols on the reels create a plurality of rows of symbols; and wherein the alteration of the at least one symbol is based upon the modifying symbol being displayed on the at least one reel in the same row of symbols as the predetermined symbol displayed on one of the plurality of reels.

3. The gaming system of claim 1, wherein the processor further causes at least one predetermined symbol to alter into a different symbol based on the modifying symbol when the at least one predetermined symbol is displayed in the first symbol display area.

4. The gaming system of claim 1, wherein the predetermined symbol is selected from all of the first set of symbols.

5. The gaming system of claim 2, wherein the second display area comprises a plurality of reels.

6. The gaming system of claim 1, wherein the plurality of randomly determined symbols displayed in the first symbol display area are displayed on a first set of reels; and wherein the predetermined symbols cause an alteration of one or more symbols located adjacent to the predetermined symbols.

7. The gaming system of claim 6, wherein the alteration of one or more symbols located adjacent to the predetermined symbols further comprise altering at least one symbol located adjacent and along a vertical axis of the predetermined symbols.

8. The gaming system of claim 6, wherein the alteration of one or more symbols located adjacent to the predetermined symbols further comprise altering all symbols that are adjacent and displayed along a vertical axis of the predetermined symbols.

9. The gaming system of claim 6, wherein the alteration of one or more symbols located adjacent to the predetermined symbols further comprise altering at least one symbol that is adjacent and displayed along a diagonal axis of the predetermined symbols.

10. The gaming system of claim 9, wherein the alteration of one or more symbols located adjacent to the predetermined symbols further comprise altering all symbols that are adjacent and displayed along a diagonal axis of the predetermined symbols.

11. The gaming system of claim 6, wherein any altered symbols behave differently after alteration.

12. The gaming system of claim 1, wherein a display position of the modifying symbol determines which displayed predetermined symbols are altered.

13. The gaming system of claim 6, wherein a content of the modifying symbol prescribes a direction for the processor to determine which of one or more symbols located adjacent to the predetermined symbols is altered.

14. The gaming system of claim 1, wherein the processor further generates a plurality of modifying symbols and displays the plurality of modified symbols in the second display area.

15. The gaming system of claim 3, wherein the processor further causes at least one predetermined symbol to alter into a plurality of different symbols at predetermined intervals, and wherein the processor evaluates each of the plurality of different symbols in combination with the symbols displayed in the first display area to determine any awards based on the symbols displayed in the first symbol display area and the wager.

16. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

displaying, on a display device of the housing, a plurality of symbol display areas including a first symbol display area and a second symbol display area;

displaying, on the display device, a display of a plurality of randomly determined symbols from a first set of a plurality of symbols in said first symbol display area;

displaying, on the display device, a second plurality of randomly determined symbols from a second set of symbols in the second symbol display area, the second plurality of randomly determined symbols further comprising at least one modifying symbol;

determining, by the processor, if any of the displayed plurality of randomly determined symbols is a predetermined symbol and if the at least one modifying symbol is horizontally aligned with any predetermined symbol;

altering, by the processor, at least one symbol of the displayed plurality of randomly determined symbols in the first symbol display area into a symbol that is different from the modifying symbol if the predetermined symbol is determined to be displayed and if the at least one modifying symbol is horizontally aligned with the predetermined symbol, wherein the at least one modifying symbol remains displayed;

determining, by the processor, any awards based on the symbols displayed in the first symbol display area and the wager, wherein the award determination is independent of the at least one modifying symbol;

displaying, on the display device, any determined awards;

increasing, by the processor, the credit balance by any determined awards; and issuing another monetary value, by the value dispenser, based on the credit balance upon receipt of a cash out signal via an input device of the gaming system.

17. The method of claim 16, wherein the at least one altered symbol is adjacent to the predetermined symbol.

18. The method of claim 16, further comprising altering a plurality of the displayed plurality of randomly determined symbols in the first symbol display area if the predetermined symbol is determined to be displayed.

19. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager, cause a display device to display a plurality of symbol display areas including a first symbol display area and a second symbol display area;

cause the display device to display a plurality of randomly determined symbols from a first set of a plurality of symbols in the first symbol display area;

cause the display device to display a second plurality of randomly determined symbols from a second set of symbols in the second symbol display area, the second plurality of randomly determined symbols further comprising at least one modifying symbol;

determine if any of the displayed plurality of randomly determined symbols is a predetermined symbol and if the at least one modifying symbol is horizontally aligned with any predetermined symbol;

alter at least one symbol of the displayed plurality of randomly determined symbols in the first symbol display area into a symbol that is different from the modifying symbol if the predetermined symbol is determined to be displayed and if the at least one modifying symbol is horizontally aligned with the predetermined symbol, wherein the at least one modifying symbol remains displayed;

determine any awards based on the symbols displayed in the first symbol display area and the wager, wherein the award determination is independent of the at least one modifying symbol;

cause the display device to display any determined awards, the credit balance being increased by any determined awards; and issue value from the value dispenser based on the credit balance upon receipt of a cash out signal via the input device.

* * * * *